US011079180B2

(12) United States Patent
Tomohiko et al.

(10) Patent No.: US 11,079,180 B2
(45) Date of Patent: Aug. 3, 2021

(54) HEAT EXCHANGER AND METHOD OF MANUFACTURING THE SAME

(71) Applicant: Samsung Electronics Co., Ltd., Suwon-si (KR)

(72) Inventors: Matsuno Tomohiko, Yokohama (JP); Tanaka Hiroyuki, Yokohama (JP); Imano Shingo, Yokohama (JP); Iwamoto Tomoharu, Yokohama (JP); Shibuya Makoto, Yokohama (JP)

(73) Assignee: Samsung Electronics Co., Ltd., Suwon-si (KR)

( * ) Notice: Subject to any disclaimer, the term of this patent is extended or adjusted under 35 U.S.C. 154(b) by 157 days.

(21) Appl. No.: 15/887,153

(22) Filed: Feb. 2, 2018

(65) Prior Publication Data

US 2018/0224210 A1 Aug. 9, 2018

(30) Foreign Application Priority Data

Feb. 3, 2017 (JP) ..... JP2017-018214
Oct. 20, 2017 (JP) ..... JP2017-204035
Jan. 11, 2018 (KR) ..... 10-2018-0003863

(51) Int. Cl.
*F28F 1/12* (2006.01)
*F28D 1/02* (2006.01)
(Continued)

(52) U.S. Cl.
CPC ..... *F28D 1/024* (2013.01); *F28D 1/0477* (2013.01); *F28F 1/126* (2013.01); *F28F 1/20* (2013.01);
(Continued)

(58) Field of Classification Search
CPC ..... F28D 1/02; F28D 1/047; F28D 1/0477; F28D 1/024; F28D 1/04; F28F 1/30;
(Continued)

(56) References Cited

U.S. PATENT DOCUMENTS 1,854,278 A * 4/1932 Smith ..... F28D 1/0477 165/182
1,957,703 A * 5/1934 Davis, Jr. ..... F28D 1/0477 29/890.047
(Continued)

FOREIGN PATENT DOCUMENTS

EP 2447656 A2 5/2012
JP 09105566 A * 4/1997
(Continued)

OTHER PUBLICATIONS

ISA/KR, "International Search Report," Application No. PCT/KR2018/001214, dated May 28, 2018, 3 pages.
(Continued)

*Primary Examiner* — Harry E Arant

(57) ABSTRACT

Disclosed is a heat exchanger that improves heat conduction performance. The heat exchanger includes at least one refrigerant tube including a plurality of sections arranged in a first direction and a plurality of heat exchanger fins arranged on the plurality of sections. Each of the plurality of heat exchanger fins includes at least one through hole provided to allow the at least one refrigerant tube to be inserted thereinto in a second direction perpendicular to the first direction and at least one contact member configured to protrude from one surface of the heat exchanger fin around the through hole and surround an outer circumferential surface of the refrigerant tube.

15 Claims, 25 Drawing Sheets

(51) Int. Cl.

| | |
|---|---|
| ***F28D 1/047*** | (2006.01) |
| ***F28F 1/20*** | (2006.01) |
| ***F28F 1/30*** | (2006.01) |
| ***F28F 1/32*** | (2006.01) |
| *F28D 21/00* | (2006.01) |

(52) U.S. Cl.
CPC ..... *F28F 1/30* (2013.01); *F28F 1/32* (2013.01); *F28D 2021/0033* (2013.01); *F28D 2021/0068* (2013.01); *F28F 2215/12* (2013.01); *F28F 2265/26* (2013.01)

(58) Field of Classification Search
CPC ..... F28F 1/20; F28F 1/126; F28F 1/22; F28F 1/24; F28F 1/12
See application file for complete search history.

(56) References Cited

U.S. PATENT DOCUMENTS

| | | | | |
|---|---|---|---|---|
| 2,437,452 | A * | 3/1948 | McKinley | F28F 9/22 165/135 |
| 2,716,802 | A * | 9/1955 | Greer, Jr. | B21D 53/08 29/890.046 |
| 2,846,196 | A * | 8/1958 | Blackford | F28D 1/024 165/122 |
| 3,889,745 | A * | 6/1975 | Siemonsen | B21D 53/085 165/151 |
| 2005/0126767 | A1 | 6/2005 | Wolk | |
| 2006/0196648 | A1* | 9/2006 | Kim | F28F 1/32 165/151 |
| 2008/0035321 | A1 | 2/2008 | Yoshioka et al. | |
| 2011/0120681 | A1 | 5/2011 | Seo et al. | |
| 2011/0168373 | A1 | 7/2011 | Kim et al. | |
| 2012/0175101 | A1 | 7/2012 | Tamura et al. | |
| 2013/0299152 | A1* | 11/2013 | Ohtani | F28D 1/05383 165/181 |
| 2014/0158333 | A1 | 6/2014 | Kim et al. | |
| 2015/0184951 | A1 | 7/2015 | Lee et al. | |

FOREIGN PATENT DOCUMENTS

| | | | | |
|---|---|---|---|---|
| JP | H09105566 | A | 4/1997 | |
| JP | 2000312937 | A * | 11/2000 | F28D 1/0477 |
| JP | 2003314973 | A | 11/2003 | |
| JP | 3748663 | B2 * | 2/2006 | F28F 1/126 |
| KR | 10-2009-0052058 | A | 5/2009 | |

OTHER PUBLICATIONS

Supplementary European Search Report in connection with European Application No. 18747977.9 dated Jan. 20, 2020, 7 pages.

* cited by examiner

| | | ROUND TUBE | FLAT TUBE |
|---|---|---|---|
| A [mm] | | 8.5 | 9.6 |
| B [mm] | | | 6.5 |
| CIRCUMFERENTIAL LENGTH [mm] | | 26.7 | |
| LENGTH OF HEAT EXCHANGE AREA [mm] | FROM SECOND SECTION OF REFRIGERANT TUBE FROM BOTTOM | 14.3 | 18.0 |
| | |  |  |
| | LOWERMOST SECTION OF REFRIGERANT TUBE | 18.8 | 21.9 |
| | |  |  |

HEAT EXCHANGER AND METHOD OF MANUFACTURING THE SAME

CROSS-REFERENCE TO RELATED APPLICATION

This application claims priority to Japanese Patent Application No. JP 2017-018214, filed Feb. 3, 2017, Japanese Patent Application No. JP 2017-204035, filed Oct. 20, 2017, and Korean Patent Application No. KR 10-2018-0003863, filed Jan. 11, 2018, the disclosures of which are fully incorporated herein by reference.

TECHNICAL FIELD

Embodiments of the present disclosure relate to a heat exchanger and a method of manufacturing the same.

BACKGROUND

A heat exchanger configured to include a heat exchanger fin having a shape of a plurality of waves formed by bending a thin plate into a wave shape to collinearly locate holes provided at the fin and align a direction of a space formed by a flat part and a curved part of the fin having the wave shape to a linear part of a meander tube has been disclosed, for example, Patent Document 1.

PRIOR ART DOCUMENT

Patent Document

Patent Document 1: Japanese Patent Laid-Open Publication Hei 9-105566

Here, when only an insertion through hole is formed at the heat exchanger fin and a refrigerant tube is inserted and passes through the insertion through hole, since the refrigerant tube and a corrugated fin come into linear contact with each other such that a heat conduction area may not be increased, heating performance is not increased.

SUMMARY

Therefore, it is an aspect of the present disclosure to provide a heat exchanger comprising improved heat conduction performance.

It is another aspect of the present disclosure to provide a heat exchanger configured to include a heat exchanger fin comprising improved heat dissipation performance.

It is still another aspect of the present disclosure to provide a heat exchanger configured to have defrosting efficiency.

Additional aspects of the present disclosure will be set forth in part in the description which follows and, in part, will be obvious from the description, or may be learned by practice of the disclosure.

In accordance with one aspect of the present disclosure, a heat exchanger includes at least one refrigerant tube configured to include a plurality of sections arranged in a first direction and a plurality of heat exchanger fins arranged on the plurality of sections. Here, each of the plurality of heat exchanger fins includes at least one through hole provided to allow the at least one refrigerant tube to be inserted thereinto in a second direction perpendicular to the first direction, and at least one contact member configured to protrude from one surface of the heat exchanger fin around the through hole and surround an outer circumferential surface of the refrigerant tube.

The contact member may be formed to be with the through hole as a whole.

The plurality of heat exchanger fins may include a first heat exchanger fin configured to have a first distance between fins and a second heat exchanger fin configured to have a second distance between fins, greater than the first distance between fins.

The heat exchanger may include an air blowing fan configured to blow air toward the heat exchanger fins. Here, the first heat exchanger fin may be disposed at a downstream side lower than the second heat exchanger fin with respect to a flow of the air blown by the air blowing fan.

Each of the heat exchanger tins may include a first flat surface disposed to be perpendicular to the refrigerant tube, a second flat surface disposed at a position adjacent to one side of the first flat surface to be perpendicular to the refrigerant tube, and a third flat surface disposed at a position adjacent to the other side opposite the one side of the first flat surface to be perpendicular to the refrigerant tube.

Each of the heat exchanger fins may further include a first connector configured to connect the first flat surface to the second flat surface and a second connector configured to connect the second flat surface to the third flat surface. Here, the first connector and the second connector may be arranged to be spaced apart from each other with the refrigerant tube interposed therebetween.

The first connector and the second connector are arranged to be parallel to a flow of air blown by the air blowing fan.

At least one of the first connector or the second connector may be formed to be concave toward the refrigerant tube.

At least one of the first connector or the second connector may include a louver formed toward the refrigerant tube.

The heat exchanger may include n air blowing fan configured to blow air toward the plurality of heat exchanger fins and a duct configured to allow the air blown by the air blowing fan to flow therethrough. Here, one or more of the plurality of heat exchanger fins may be arranged to be spaced apart from a wall surface of the duct.

A depth of the heat exchanger fin in a direction perpendicular to a flow of the air blown by the air blowing fan may be the same as or smaller than a depth of the duct.

The plurality of heat exchanger fins may include a first heat exchanger fin in contact with one wall surface of the duct and a second heat exchanger fin in contact with the other wall surface of the duct, that faces the one wall surface of the duct. Here, the first heat exchanger fin and the second exchanger fin may be alternately arranged along the first direction.

The heat exchanger may include an air blowing fan configured to blow air toward the heat exchanger fins. Here, the refrigerant tube may be configured to include a flat shape in which a first width extending in a direction parallel to a flow of the air blown by the air blowing fan and a second width extending in a direction perpendicular to the flow of the air blown by the air blowing fan are different from each other.

The first width may be greater than the second width.

Each of the plurality of heat exchanger fins may include a plurality of flat surfaces arranged in the second direction. Here, between two adjacent flat surfaces of the plurality of flat surfaces, a ratio between a contact area of a part at which the contact member is in contact with the refrigerant tube and a non-contact area of a part at which the contact member does not come into contact with the refrigerant tube may be greater than 0 and smaller than 40.

Each of the plurality of heat exchanger fins may further include a pair of heat exchanger plates, through which the refrigerant tube passes, and an expansion plate configured to extend in the second direction and connect the pair of heat exchanger plates to each other.

The plurality of heat exchanger fins may include a first heat exchanger fin configured to include a first expansion plate disposed on one side of the refrigerant tube and a second heat exchanger fin configured to include a second expansion plate disposed on the other side of the refrigerant tube opposite the one side of the refrigerant tube.

The first expansion plate and the second expansion plate may be alternately arranged along the second direction.

At least one part of the first expansion plate and at least one part of the second expansion plate may be arranged to face each other.

In accordance with another aspect of the present disclosure, a method of manufacturing a heat exchanger includes manufacturing a plurality of heat exchanger fins including a plurality of through holes and a plurality of contact members connected to the plurality of through holes, respectively, inserting a refrigerant tube into each of the plurality of through holes to pass therethrough, allowing an outer circumferential surface of the refrigerant tube and an inner circumferential surface of the contact member to come into contact with each other by enlarging a diameter of the refrigerant tube, and bending the refrigerant tube a plurality of times to form a plurality of sections at the refrigerant tube.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

Definitions for certain words and phrases are provided throughout this patent document. Those of ordinary skill in the art should understand that in many, if not most instances, such definitions apply to prior, as well as future uses of such defined words and phrases.

BRIEF DESCRIPTION OF THE DRAWINGS

These and/or other aspects of the present disclosure will become apparent and more readily appreciated from the following description of the embodiments, taken in conjunction with the accompanying drawings of which.

DETAILED DESCRIPTION

FIGS. 1 through 24 discussed below, and the various embodiments used to describe the principles of the present disclosure are by way of illustration only and should not be construed in any way to limit the scope of the disclosure. Those skilled in the art will understand that the principles of the present disclosure may be implemented in any suitably arranged system or device.

Schema of First to Seventh Embodiments

In a heat exchanger configured to perform heat exchange between a refrigerant compressed by a compressor to circulate air blown by an air blower, the first to seventh embodiments of the present disclosure are for improving an assembling property and a reliability of the heat exchanger by using an independent corrugated fin in an approximate rectangular shape for the heat exchanger as well as improving heat exchange performance by increasing a heat conduction area.

Optimal components of the heat exchanger according to devices or parts to which the components are applied may be randomly set by combining independent corrugated fins in an approximate rectangular shape and comprising different inter-fin distances.

Heat exchange performance may be improved by reducing a windage loss using a flat refrigerant tube.

First Embodiment

Figure 1:
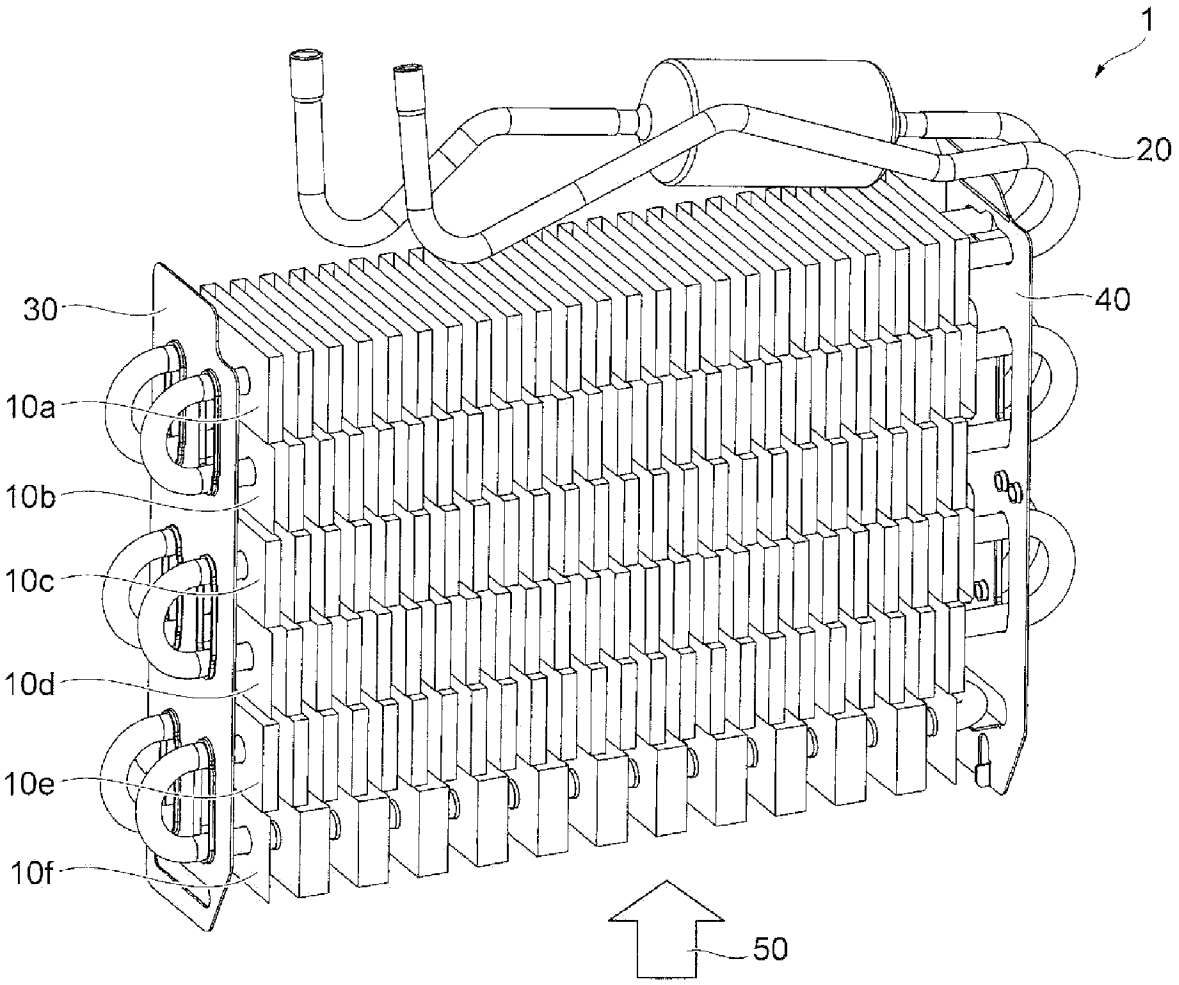
FIG. 1 illustrates a configuration diagram of a whole heat exchanger according to a first embodiment of the present disclosure.

FIG. 1 is a configuration diagram of a heat exchanger 1 according to a first embodiment. As shown in FIG. 1, the heat exchanger 1 according to the first embodiment includes corrugated fins 10*a*, 10*b*, 10*c*, 10*d*, 10*e*, and 10*f*, a refrigerant tube 20, and end plates 30 and 40. The corrugated fins 10*a*, 10*b*, 10*c*, 10*d*, 10*e*, and 10*f* are an example of heat exchange fins that perform heat exchange.

The corrugated fins 10*a*, 10*b*, 10*c*, 10*d*, 10*e*, and 10*f* may be independent corrugated fins and may be single corrugate fins disposed on a first section, a second section, a third section, a fourth section, a fifth section, and a sixth section of the heat exchanger 1, respectively. The corrugated fins 10*a*, 10*b*, 10*c*, 10*d*, 10*e*, and 10*f* will be described below in detail.

The refrigerant tube 20 includes a pair of tubes in which a refrigerant flows. The pair of tubes may be bent in a meander shape and configured to insert into and pass through the corrugated fins 10*a*, 10*b*, 10*c*, 10*d*, 10*e*, and 10*f* That is, the pair of tubes may be inserted into and pass through the corrugated fin 10*a*, bent in a U shape, inserted into and pass through the corrugated fin 10*b*, and then sequentially inserted into and pass through the corrugated fins 10*c*, 10*d*, and 10*e* likewise. Finally, the pair of tubes may be inserted into and pass through the corrugated fin 10*f*, and coupled to each other by a tube comprising a U shape. Hereby, a refrigerant flows into any one of the pair of tubes, flows through the heat exchanger 1, and then flows out through the other of the pair of tubes. The refrigerant tube 20 may be closely attached and fixed to the corrugated fins 10*a*, 10*b*, 10*c*, 10*d*, 10*e*, and 10*f* by tube expansion.

The end plate 30 may be a board configured to suppress a U shape part of the refrigerant tube 20 between the corrugated fins 10*a* and 10*b*, a U shape part of the refrigerant tube 20 between the corrugated fins 10*c* and 10*d*, and a U shape part of the refrigerant tube 20 between the corrugated fins 10*e* and 10*f* not to be broken by a stress.

The end plate 40 may be a board configured to suppress a U shape part of the refrigerant tube 20 between the corrugated fins 10*b* and 10*c* and a U shape part of the refrigerant tube 20 between the corrugated fins 10*d* and 10*e* not to be broken by a stress.

The heat exchanger 1 may receive an air flow in a first direction. The first direction is a direction indicated from an air blowing fan (not shown) along an arrow 50.

Continuously, the corrugated fins 10*a*, 10*b*, 10*c*, 10*d*, 10*e*, and 10*f* shown in FIG. 1 will be described below in detail.

Figure 2:
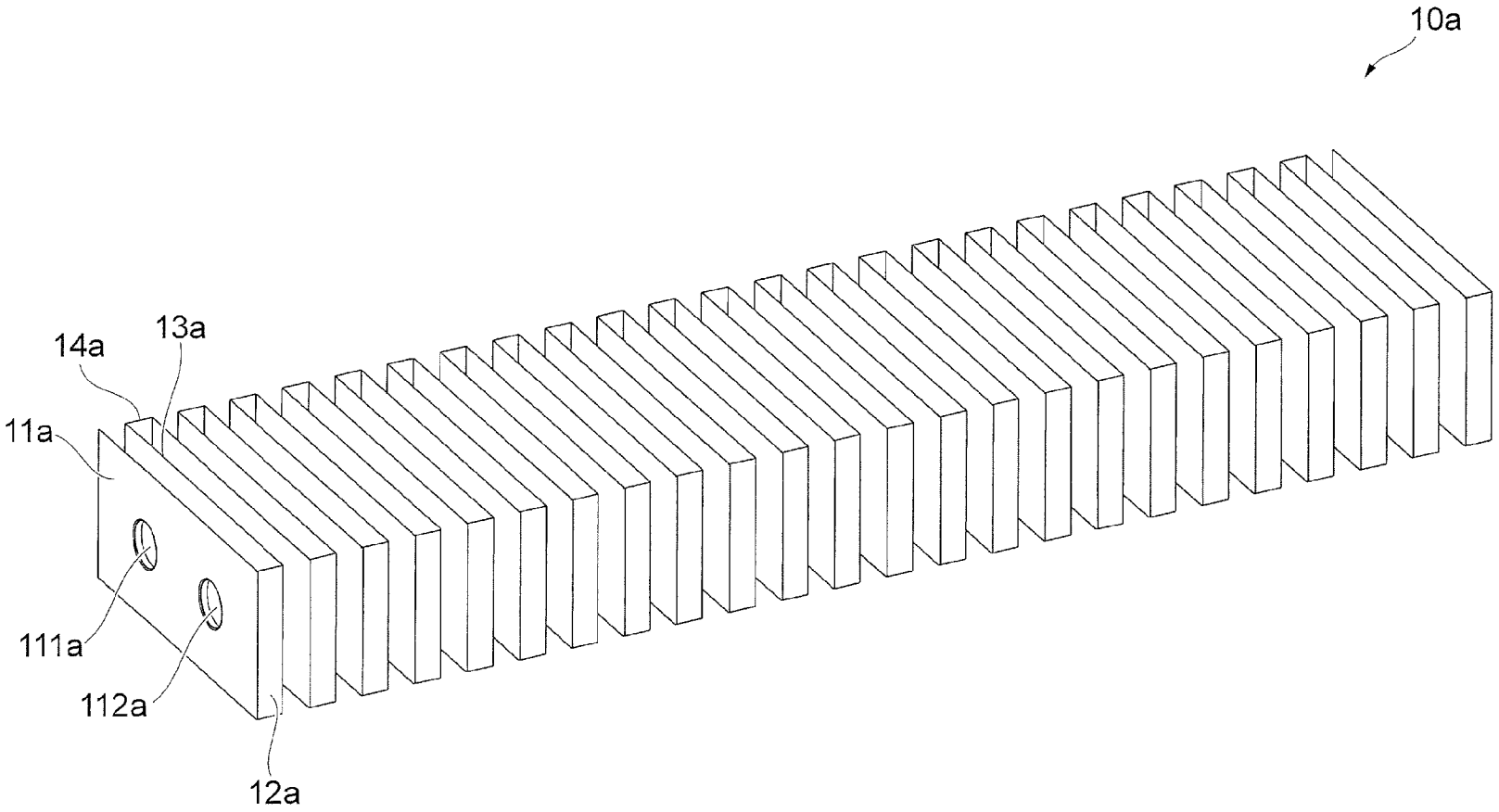
FIG. 2 is a view illustrating components of a corrugated fin disposed on a first section of the heat exchanger according to the first embodiment of the present disclosure.

FIG. 2 is a view illustrating components of the corrugated fin 10*a*.

As shown in FIG. 2, the corrugated fin 10*a* may be formed by bending a flat aluminum plate repeatedly to form a perpendicular surface 11*a* approximately perpendicular to the refrigerant tube 20, a flat ridge surface 12*a*, a perpendicular surface 13*a* approximately perpendicular to the refrigerant tube 20, and a flat valley surface 14*a*. In one embodiment, as an example of a first corrugated fin, the corrugated fin 10*a* may be installed. The perpendicular surface 11*a* may be installed as an example of a first flat surface, the perpendicular surface 13*a* may be installed as an example of a second flat surface, and a perpendicular surface opposite the perpendicular surface Ha, adjacent to the perpendicular surface 13*a*, and approximately perpendicular to the refrigerant tube 20 may be installed as an example of a third flat surface. The ridge surface 12*a* may be installed as an example of a first connector that is configured to connect the first flat surface and the second flat surface to each other, and the valley surface 14*a* may be installed as an example of a second connector that is configured to connect the second flat surface and the third flat surface to each other. In this embodiment, because the perpendicular surface Ha and the ridge surface 11*a*, the ridge surface 12*a* and the perpendicular surface 13*a*, and the perpendicular surface 13*a* and the valley surface 14*a* are approximately perpendicular to each other, the corrugated fin 10*a* may be formed by bending a flat plate to be an approximately rectangular shape. In FIG. 2, a distance between the perpendicular surface 11*a* and the perpendicular surface 13*a* (distance between fins) may be set to be 5 mm. The distance between the perpendicular surface 11*a* and the perpendicular surface 13*a* is an example of a distance between first fins.

The perpendicular surface 11*a* includes an insertion through hole 111*a* through which any one of the pair of tubes of the refrigerant tube 20 may be inserted and pass in a second direction perpendicular to the first direction, and an insertion through hole 112*a* through which the other of the pair of tubes of the refrigerant tube 20 may be inserted and pass in the second direction perpendicular to the first direction. The perpendicular surface 13*a* may include an insertion through hole (not shown) through which any one of the pair of tubes of the refrigerant tube 20 may be inserted and pass and an insertion through hole (not shown) through which the other of the pair of tubes of the refrigerant tube 20 may be inserted and pass.

Since components of the corrugated fins 10*b*, 10*c*, 10*d*, and 10*e* are the same as those of the corrugated fin 10*a*, a description thereof will be omitted.

Figure 3:
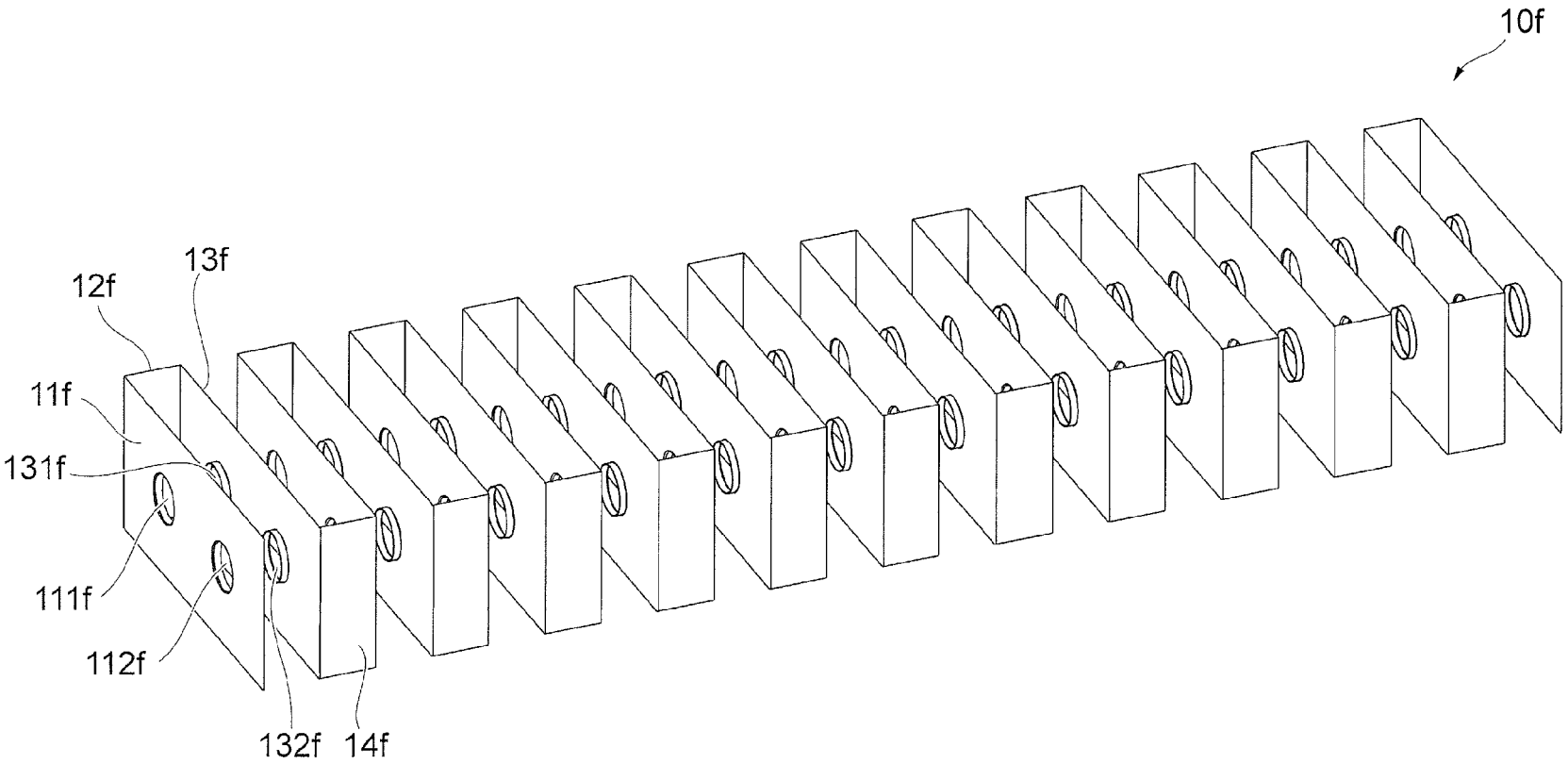
FIG. 3 is a view illustrating components of a corrugated fin disposed on a sixth section of the heat exchanger according to the first embodiment of the present disclosure.

FIG. 3 is a view illustrating components of the corrugated fin 10*f*.

As shown in FIG. 3, the corrugated fin 10*f* may be formed by bending a flat aluminum plate repeatedly to form a perpendicular surface 11*f* approximately perpendicular to the refrigerant tube 20, a flat ridge surface 12*f*, a perpendicular surface 13*f* approximately perpendicular to the refrigerant tube 20, and a flat valley surface 14*f*. In this embodiment, as an example of a second corrugated fin, the corrugated fin 10*f* is installed. The perpendicular surface 11*f* may be installed as an example of a first flat surface, the perpendicular surface 13*f* may be installed as an example of a second flat surface, and a perpendicular surface opposite the perpendicular surface 11*f*, adjacent to the perpendicular surface 13*f*, and approximately perpendicular to the refrigerant tube 20 may be installed as an example of a third flat surface. The ridge surface 12*f* may be installed as an example of a first connector configured to connect the first flat surface and the second flat surface to each other, and the valley surface 14*f* may be installed as an example of a second connector configured to connect the second flat surface and the third flat surface to each other. Because the perpendicular surface 11*f* and the ridge surface 12*f*, the ridge surface 12*f* and the perpendicular surface 13*f*, and the perpendicular surface 13*f* and the valley surface 14*f* are approximately perpendicular to each other, the corrugated fin 10*f* may be formed by bending a flat plate to be an approximately rectangular shape. In FIG. 3, a distance between the perpendicular surface 11*f* and the perpendicular surface 13*f* (distance between fins) may be set to be 10 mm. The distance between the perpendicular surface 11*f* and the perpendicular surface 13*f* is an example of a distance between second fins.

The perpendicular surface 11*f* includes an insertion through hole 111*f* through which any one of the pair of tubes of the refrigerant tube 20 may be inserted and pass and an insertion through hole 112*f* through which the other of the pair of tubes of the refrigerant tube 20 may be inserted and pass. The perpendicular surface 13*f* includes an insertion through hole 131*f* through which any one of the pair of tubes of the refrigerant tube 20 may be inserted and pass and an insertion through hole 132*f* through which the other of the pair of tubes of the refrigerant tube 20 may be inserted and pass.

Although FIGS. 2 and 3 illustrate embodiments that comprise a distance between fins is 5 mm and 10 mm, the distance between fins is not limited thereto. For example, in embodiments where the heat exchanger 1 is used as an evaporator, the distance between fins may be set to 3 mm to 20 mm. If the distance between fins is less than 3 mm, in consideration of frost obstruction between fins, the heat exchanger 1 may experience difficulty being used as an evaporator. If the distance between fins is more than 20 mm, it is not practical to use the heat exchanger as an evaporator because a size of a heat exchanger is enlarged for securing heat exchange performance.

Structures of the corrugated fins 10*a*, 10*b*, 10*c*, 10*d*, 10*e*, and 10*f* shown in FIGS. 2 and 3 will be described below in detail.

Figure 4:
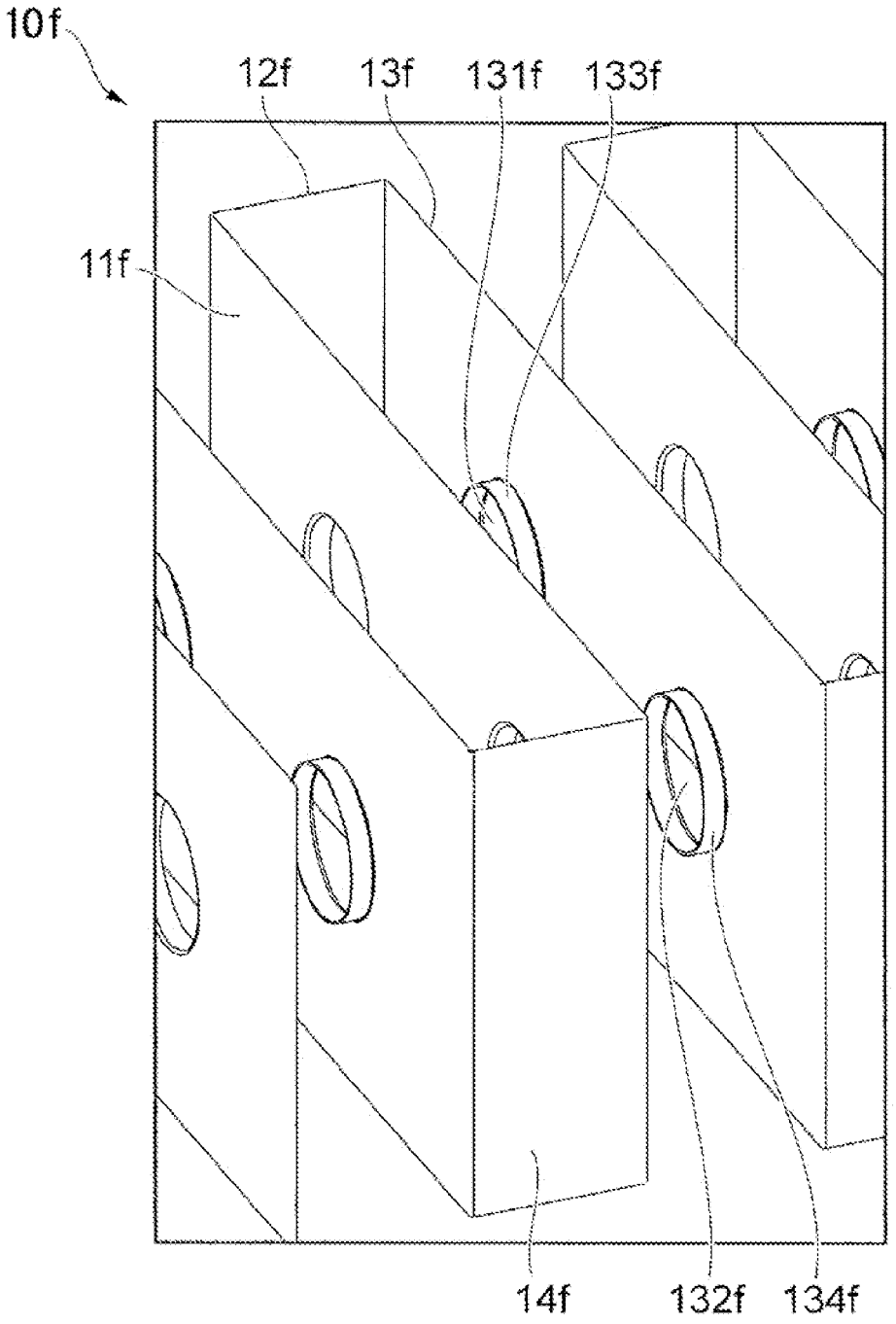
FIG. 4 is a partially enlarged view illustrating the components of the corrugated fin disposed on the sixth section of the heat exchanger according to the first embodiment of the present disclosure.

FIG. 4 is an enlarged view illustrating a part of the corrugated fin 10*f* Although FIG. 4 depicts corrugated fin 101, the description below may apply to each of corrugated fins 10*a*, 10*b*, 10*c*, 10*d*, and 10*e* as well. Collars 113*f* and 114*f* are provided at the insertion through holes 111*f* and 112*f* of the perpendicular surface 11*f* of the corrugated fin 10*f*, as an example of contact members for allowing the pair of tubes of the refrigerant tube 20 to come into contact with the corrugated fin 10*f*. Also, collars 133*f* and 134*f* are provided at the insertion through holes 131*f* and 132*f* of the perpendicular surface 13*f* of the corrugated fin 10*f*, as an example of contact members for allowing the pair of tubes of the refrigerant tube 20 to come into contact with the corrugated fin 10*f* The collars 133*f* and 134*f* are configured to protrude from one surface of the corrugated fin 10*f* around the insertion through holes 131*f* and 132*f* to surround outer circumferential surfaces of the pair of tubes of the refrigerant tube 20.

However, here, because it is on the premise that a flat plate is bent to be an approximately rectangular shape while the collars 113*f*, 114*f*, 133*f*, and 134*f* are formed therein, only the collars 133*f* and 134*f* are shown in FIG. 4. In addition, because it is on the premise that a flat plate is bent to be an approximately rectangular shape while the insertion through holes 111*f*, 112*f*, 131*f*, and 132*f* are formed therein, only the insertion through holes 131*f* and 132*f* are shown in FIG. 4.

Although the corrugated fins 10*a*, 10*b*, 10*c*, 10*d*, and 10*e* also include collars as an example of contact members, the collars are the same as those of the corrugated fin 10*f* and a description thereof will be omitted.

Continuously, a relationship between an area of the perpendicular surface 11 of the corrugated fin 10 and a cross section of the refrigerant tube 20 will be described. Hereinafter, the corrugated fins 10*a*, 10*b*, 10*c*, 10*d*, 10*e*, and 10*f* will be referred to as the corrugated fin 10 without distinguishing them from one another for the convenience of description.

Figure 5:
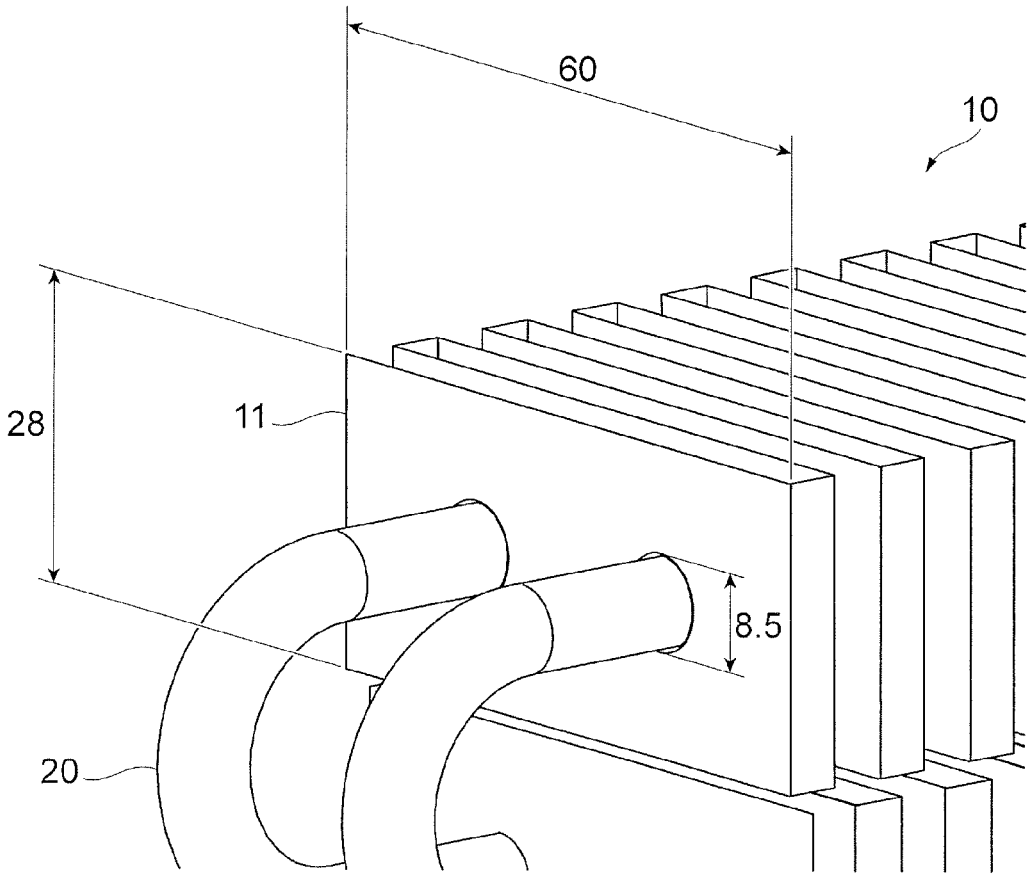
FIG. 5 is a view illustrating a relationship between an area of a perpendicular surface of a corrugated fin and a cross section of a refrigerant tube of a heat exchanger according to one embodiment of the present disclosure.

FIG. 5 is a view illustrating the relationship between an area of a perpendicular surface 11 of the corrugated fin 10 and a cross section of the refrigerant tube 20. In one embodiment, as shown in FIG. 5, an outer diameter of the refrigerant tube 20 after tube expansion may be 8.5 mm. For example, the refrigerant tube 20 having an outer diameter of 8.0 mm may be expanded to have an outer diameter of 8.5 mm. Also, lengths of two sides of the perpendicular surface 11 are shown as 28 mm and 60 mm, respectively. In this embodiment, a cross section A of the refrigerant tube 20 after tube expansion becomes 56.7 $mm^2$ ($=\pi\times(8.5\ mm/2)^2$). In this embodiment, an area B of a part of the perpendicular surface 11, that is heat-exchanged by one of the refrigerant tube 20, becomes 840 $mm^2$ ($=(28\ mm\times60\ mm)/2$). Accordingly, a ratio of A to B, A/B, is 0.0675($=56.7\ mm^2/840\ mm^2$), and a range of A/B may be set to be $0.02\leq A/B\leq0.1$.

When A/B is less than 0.02, with respect to the area of the perpendicular surface 11, an outer diameter (and an inner diameter) of the refrigerant tube 20 becomes excessively smaller. For example, when lengths of two sides of the perpendicular surface 11 are set to be 28 mm and 60 mm, respectively, as shown in FIG. 5, but A/B is less than 0.02, an outer diameter of the refrigerant tube 20 after tube expansion becomes less than 4.6 mm and an outer diameter of the refrigerant tube 20 before tube expansion becomes less than about 4.5 mm. Accordingly, it becomes very difficult to tube-expand the refrigerant tube 20.

When A/B becomes 0.1 or more, the area of the perpendicular surface 11 becomes excessively smaller with respect to the refrigerant tube 20. For example, when the outer diameter of the refrigerant tube 20 after tube expansion is 8.5 mm and a length of a longitudinal side of the perpendicular surface 11 is 28 mm, as shown in FIG. 5, but A/B is 0.1 or more, a lateral side of the perpendicular surface 11 becomes 40 mm or less. Accordingly, since it is difficult to obtain adequate heat exchange performance, it is not practical.

Hereinafter, a method of manufacturing the heat exchanger 1 according to the first embodiment will be described.

Figure 6:
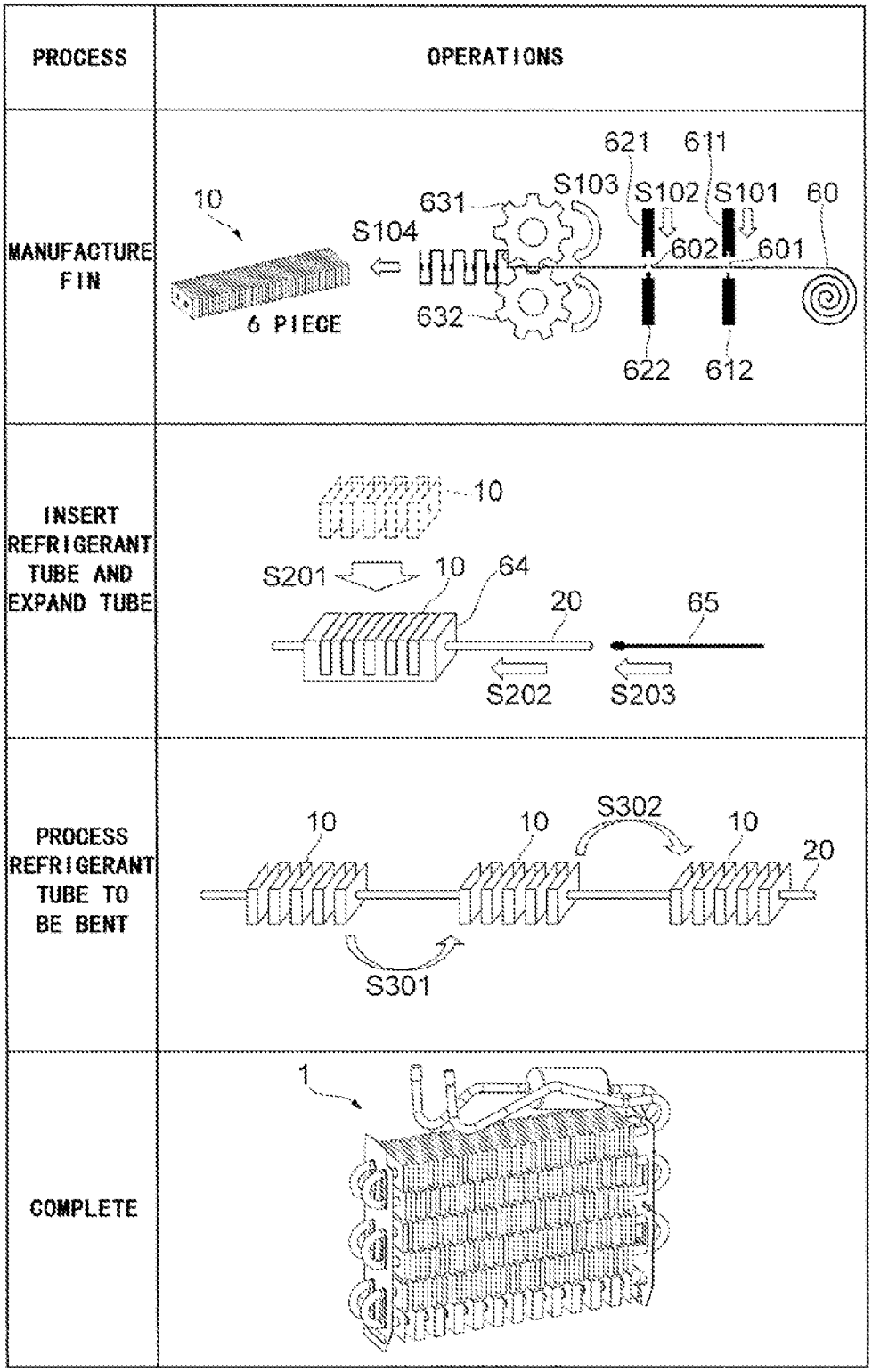
FIG. 6 is a view illustrating a method of manufacturing a heat exchanger according to the first embodiment of the present disclosure.

FIG. 6 is a view illustrating the method of manufacturing the heat exchanger 1 according to the first embodiment. The manufacturing method illustrated in FIG. 6 is an example and any manufacturing methods that obtain the heat exchanger 1 described with reference to FIGS. 1 to 4 as a result may be available. In some embodiments, a part or the entire of the manufacturing method may be performed using machines.

First, in a fin-manufacturing process, an insertion through hole 601 is formed at a flat plate 60 by molds 611 and 612 (S101). Continuously, a peripheral part of the insertion through hole 601 of the flat plate 60 is raised to stand by molds 621 and 622 such that a collar 602 is formed (S102). Continuously, the flat plate 60 is bent to be an approximately rectangular shape (may be referred to as a pulse shape) by molds 631 and 632 (S103). The corrugated fin 10 shown in FIGS. 2 and 3 is completed (S104). Although not shown, because the method ultimately results in the manufacture of the heat exchanger 1 shown in FIG. 1, six corrugated fins 10 are manufactured.

Second, in a refrigerant tube insertion and tube expansion process, a worker manually inserts the corrugated fins 10 into a fin supporting jig 64 one by one (S201). Although only an image in which one corrugated fin 10 is inserted into fin supporting jig 64 is shown in FIG. 6, when six corrugated fins 10 are manufactured in the fin manufacturing process, each of the corrugated fins 10 is inserted into each of six fin supporting jigs 64. Continuously, the refrigerant tube 20 is inserted into the fin supporting jig 64 (S202). Although only an image in which the refrigerant tube 20 is inserted into one fin supporting jig 64 is shown in FIG. 6, when six corrugated fins 10 are manufactured in the fin manufacturing process, the refrigerant tube 20 is inserted into the six fin supporting jigs 64 arranged in a series. At this point, although the corrugated fin 10 is not in close contact with the refrigerant tube 20, continuously, the refrigerant tube 20 is tube-expanded by a tube expansion jig 65 such that the corrugated fin 10 comes into close contact with the refrigerant tube 20 (S203). Although only an image in which one corrugated fin 10 comes into close contact with one refrigerant tube 20 is shown in FIG. 6, when six corrugated fins 10 are manufactured in the fin manufacturing process, the six corrugated fins 10 come into close contact with one refrigerant tube 20 at or about the same time.

Third, in a refrigerant bending process, while the refrigerant tube 20 is inserted into and comes into contact with the corrugated fin 10, the refrigerant tube 20 is bent to form a bent portion at a bottom in the drawing (S301) and to form a bent portion at a top in the drawing (S302). In some embodiments, the bending in 301 and the bending in 302 may be performed at the same time.

The heat exchanger 1 is completed through the above processes.

As described above, in the first embodiment, the independent approximately rectangular-shaped corrugated fin 10 may be disposed on each section of the heat exchanger 1. Hereby, a heat conduction area in the same occupied volume may be expanded and heat exchange performance may be improved. In some embodiments, a plurality of fins may be integrated on one corrugated fin 10.

Additionally, because the approximately rectangular-shaped corrugated fin 10 is independently disposed on each section, the same manufacturing method as that of inserting fins into a jig one by one may be employed. In some embodiments, effort may be reduced for inserting fins into a jig one by one such that a manufacturing time may be reduced.

In this embodiment, because the number of components that form the heat exchanger 1 is sharply reduced, management of components may be improved.

In the first embodiment, the collars 113, 114, 133, and 134 are molded at the insertion through holes 111, 112, 131, and 132 of the corrugated fin 10 as a whole. When the refrigerant tube 20 is inserted into and passes through the insertion through holes 111, 112, 131, and 132 while the insertion through holes 111, 112, 131, and 132 are formed at the corrugated fin 10, in comparison to heat transfer through linear contact between the refrigerant tube 20 and the corrugated fin 10, in the first embodiment, because heat is transferred through surface contact between the refrigerant tube 20 and the corrugated fin 10 such that a heat conduction area between the refrigerant tube 20 and the corrugated fin 10 increases, heat conduction performance is improved.

Also, in the first embodiment, the refrigerant tube 20, while having a diameter smaller than diameters of the insertion through holes 111, 112, 131, and 132 of the corrugated fin 10, is inserted into and passes through the insertion through holes 111, 112, 131, and 132 and then tube-expanded. Hereby, since adhesion becomes excellent in comparison to forcible insertion of the refrigerant tube 20 having a diameter greater than diameters of the insertion through holes 111, 112, 131, and 132, heat conduction performance is improved such that heat exchange performance is improved.

Further, because the approximately rectangular-shaped corrugated fin 10 is independently disposed on each section, a distance between fins in some sections may be easily adjusted at a low cost according to a use or an applied model. For example, in the case of a refrigerator and the like, dew formation or a freeze may easily occur at an upstream wind side such that a wind flow may be undermined and heat exchange performance may be deteriorated. Accordingly, a distance between fins at the air box side may be longer than a distance between fins at a downstream wind side such that performance deterioration may be prevented.

Second Embodiment

Because the heat exchanger 1 according to a second embodiment is like the heat exchanger 1 according to the first embodiment except that one refrigerant tube 20 may be inserted into and pass through a corrugated fi description on repeated parts will be omitted, and here, only the corrugated tin 70 according to the second embodiment will be described.

Figure 7:
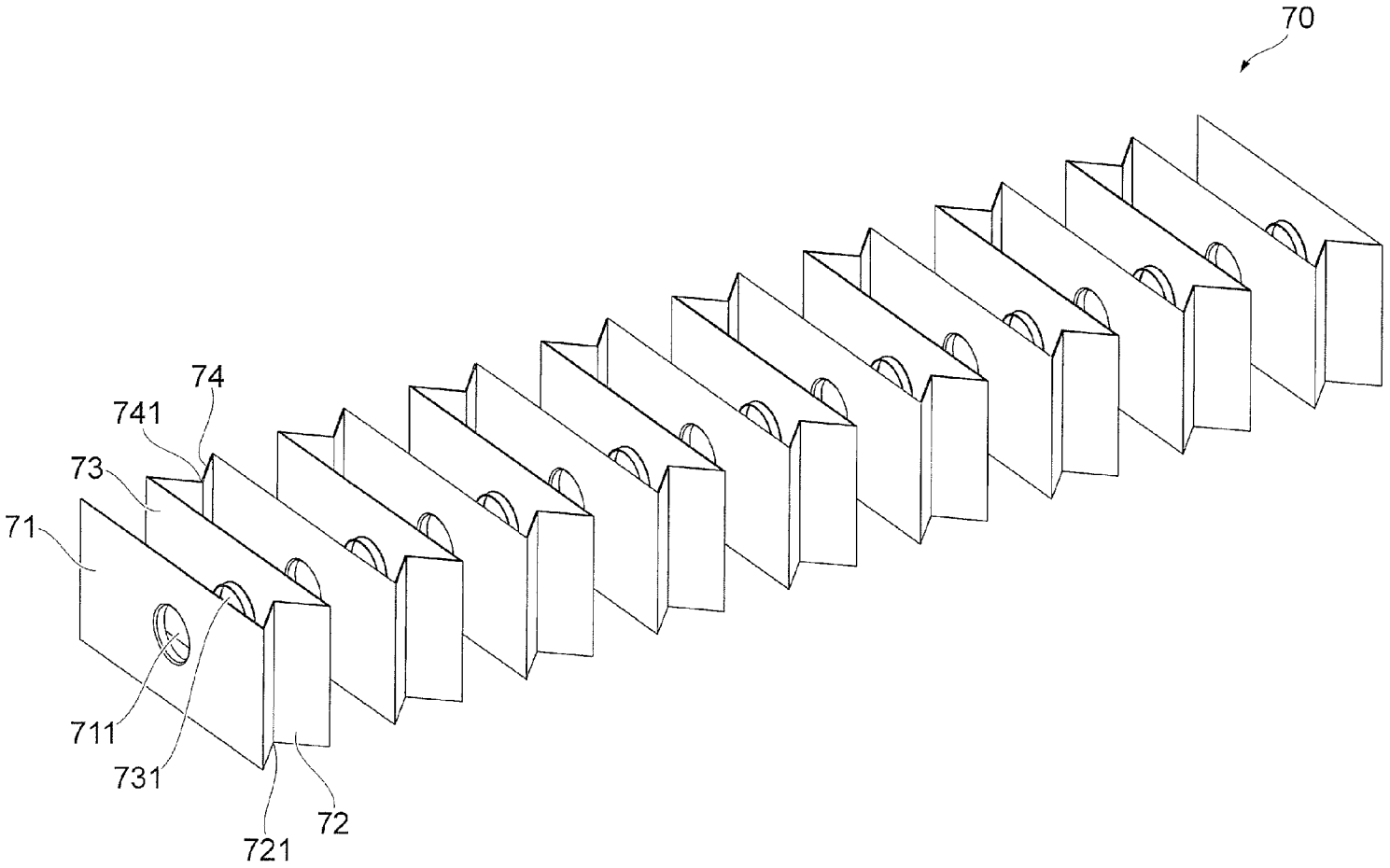
FIG. 7 is a view illustrating components of a corrugated fin of a heat exchanger according to a second embodiment of the present disclosure.

FIG. 7 is a view illustrating components of the corrugated fin 70 according to the second embodiment.

As shown in FIG. 7, the corrugated fin 70 according to the second embodiment may be formed by bending a flat aluminum plate repeatedly to form a perpendicular surface 71 approximately perpendicular to the refrigerant tube 20, a ridge surface 72, a perpendicular surface 73 approximately perpendicular to the refrigerant tube 20, and a valley surface 74. In the embodiment, the perpendicular surface 71 is installed as an example of a first flat surface, the perpendicular surface 73 is installed as an example of a second flat surface, and a perpendicular surface opposite the perpendicular surface 71, adjacent to the perpendicular surface 73, and approximately perpendicular to the refrigerant tube 20 is installed as an example of a third flat surface. The ridge surface 72 may be installed as an example of a first connector configured to connect the first flat surface and the second flat surface to each other, and the valley surface 74 may be installed as an example of a second connector configured to connect the second flat surface and the third flat surface to each other. In this embodiment, because the perpendicular surface 71 and the ridge surface 72, the ridge surface 72 and the perpendicular surface 73, and the perpendicular surface 73 and the valley surface 74 are approximately perpendicular to each other, the corrugated fin 70 may be formed by bending a flat plate to be an approximately rectangular shape.

The perpendicular surface 71 includes an insertion through hole 711 through which the refrigerant tube 20 may be inserted and pass, and the perpendicular surface 73 includes an insertion through hole 731 through which the refrigerant tube 20 may be inserted and pass. In the second embodiment, collars may be provided at the insertion through holes 711 and 731 as an example of contact members.

In the second embodiment, an approximate M-shaped part 721 may be provided at the ridge surface 72, and an approximate M-shaped part 741 may be provided at the valley surface 74. In various embodiments, an approximate M-shaped part may be provided at any one of the ridge surface 72 and the valley surface 74.

In the second embodiment, a concave shape toward the refrigerant tube 20 may be provided to at least one of the ridge surface 72 or the valley surface 74. Hereby, it is possible to increase a heat conduction area of the corrugated fin 10 according to the first embodiment, so an increase in heat exchange performance may be expected. Because performance of the heat exchanger 1 may be improved while a distance between fins may be provided to a certain degree, a decrease in performance caused by frost obstruction due to dew formation is small in embodiments where the heat exchanger 1 is used as an evaporator.

Third Embodiment

Because the heat exchanger 1 according to a third embodiment is like the heat exchanger 1 according to the first embodiment except that one refrigerant tube 20 is inserted into and passes through a corrugated fin 80, a description on repeated parts will be omitted, and therefore, only the corrugated fin 80 according to the third embodiment will be described.

Figure 8:
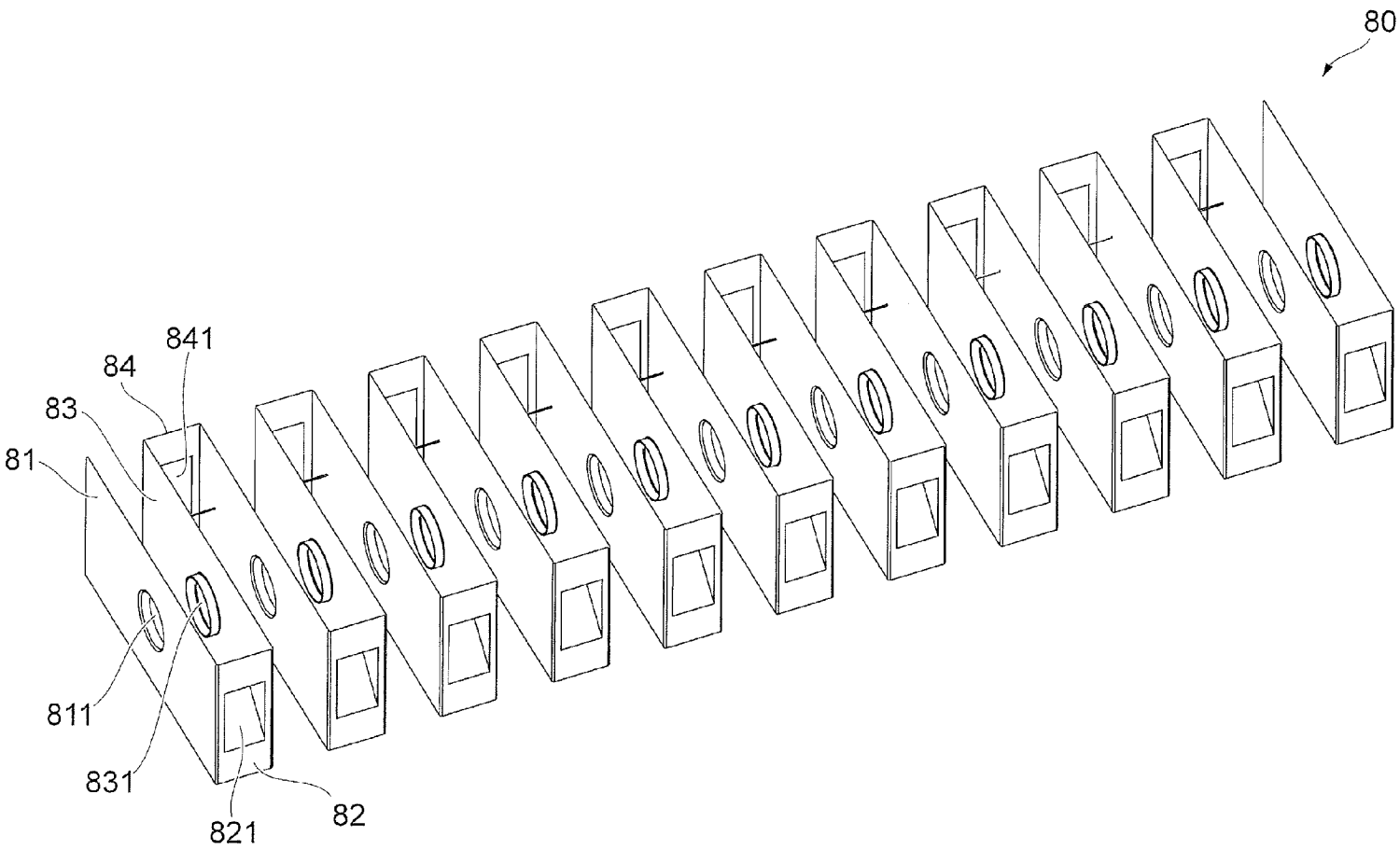
FIG. 8 is a view illustrating components of a corrugated fin of a heat exchanger according to a third embodiment of the present disclosure.

FIG. 8 is a view illustrating components of the corrugated fin 80 according to the third embodiment.

As shown in FIG. 8, the corrugated fin 80 according to the third embodiment is formed by bending a flat aluminum plate repeatedly to form a perpendicular surface 81 approximately perpendicular to the refrigerant tube 20, a flat ridge surface 82, a perpendicular surface 83 approximately perpendicular to the refrigerant tube 20, and a flat valley surface 84. In the third embodiment, the perpendicular surface 81 may be installed as an example of a first flat surface, the perpendicular surface 83 may be installed as an example of a second flat surface, and a perpendicular surface opposite the perpendicular surface 81, adjacent to the perpendicular surface 83, and approximately perpendicular to the refrigerant tube 20 may be installed as an example of a third flat surface. The ridge surface 82 may be installed as an example of a first connector that is configured to connect the first flat surface and the second flat surface to each other, and the valley surface 84 may be installed as an example of a second connector that is configured to connect the second flat surface and the third flat surface to each other. Because the perpendicular surface 81 and the ridge surface 82, the ridge surface 82 and the perpendicular surface 83, and the perpendicular surface 83 and the valley surface 84 are approximately perpendicular to each other, the corrugated fin 80 is formed by bending a flat plate to be an approximately rectangular shape.

Also, the perpendicular surface 81 includes an insertion through hole 811 through which the refrigerant tube 20 may be inserted and pass, and the perpendicular surface 83 includes an insertion through hole 831 through which the refrigerant tube 20 may be inserted and pass. In the third embodiment, collars may be provided at the insertion through holes 811 and 831 as an example of contact members.

In the third embodiment, a louver (cut-to-stand member) 821 may be provided at the ridge surface 82, and a louver 841 may be provided at the valley surface 84. In various embodiments, a louver may be provided at any one of the ridge surface 82 and the valley surface 84.

In the third embodiment, a louver 821 or 841 is provided to at least one of the ridge surface 82 or the valley surface 84. In this embodiment, it is possible to allow air that passes through the heat exchanger 1 to be a warm current such that improvement of heat exchange performance may be expected.

Fourth Embodiment

Figure 9:
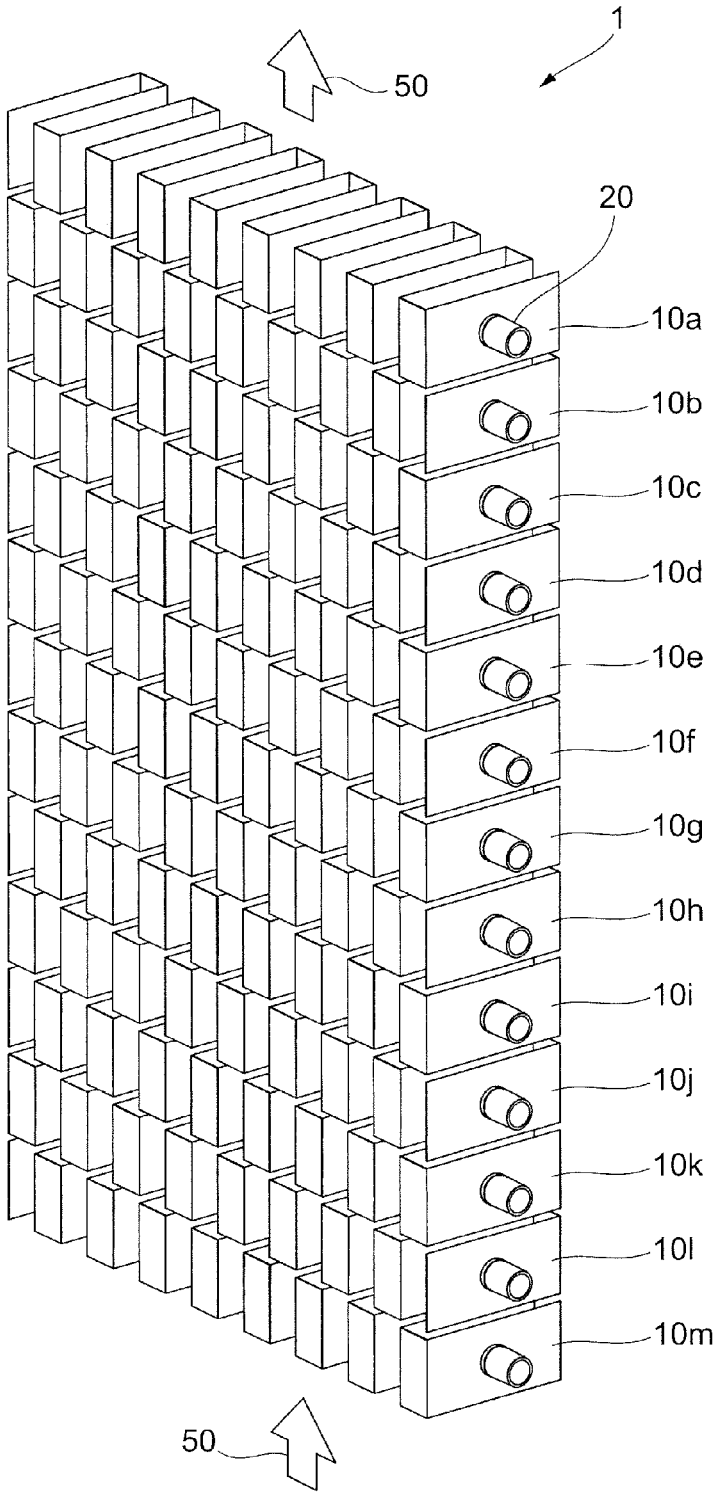
FIG. 9 is a view illustrating a structure of the heat exchanger according to the first embodiment of the present disclosure for comparing with a heat exchanger according to a fourth embodiment of the present disclosure.

FIG. 9 is a view illustrating a structure of the heat exchanger 1 according to the first embodiment to compare with the heat exchanger 1 according to the fourth embodiment. As shown in FIG. 9, the heat exchanger 1 according to the fourth embodiment includes corrugated fins 10*a* through 10*m* and the refrigerant tube 20.

The corrugated fins 10*a* to 10*m* may be a plurality of sections of corrugated fins 10 that are configured to come into thermal contact with the refrigerant tube 20 and perform heat exchange with air. Although the number of sections of the corrugated fin 10 is six in FIG. 1, as shown in FIG. 9 the corrugated fin 10 contains thirteen sections, corrugated fins 10*a* to 10*m*.

The refrigerant tube 20 may be a tube configured to allow a refrigerant to flow. FIG. 1 illustrates a structure in which the refrigerant tube 20 is provided as a pair of tubes, and FIG. 9 illustrates a structure in which the refrigerant tube 20 is provided as one tube.

The heat exchanger 1 receives an air flow in the first direction. The first direction is a direction indicated from the air blowing fan, that is not shown along the arrow 50.

Heat transfer between fins and air may be performed by forcible convection current heat transfer. Because a forcible convection current heat transfer rate (hereinafter, simply referred to as "heat transfer rate") is generally proportional to 0.8 square of Reynolds number, a heat transfer rate increases as an air speed increases. The air speed is zero (0) at a call surface of a duct, which is a stop wall, increases from the wall surface of the duct toward a central part of the duct, and is maximized at a center of the duct. Accordingly, a heat transfer rate at the fins of the heat exchanger 1 differs at the center of the duct or near the wall surface of the duct and decreases near the wall surface of the duct.

The forcible convection current heat transfer rate may be greatly influenced by a temperature boundary layer formed between air and a surface of the fin. The temperature boundary layer may be formed because the air comes into contact with the fin such that a temperature of the air is decreased. The theoretical thickness of the temperature boundary layer may be zero (0) at a part at which the air and the fin initially come into contact with each other, and the thickness thereof increases according to a flow toward a downstream side. At an upstream side, because the air and the fin are heat-exchanged with a thin temperature boundary layer, a heat transfer rate increases. Meanwhile, at the downstream side, since heat exchange is performed with a thick boundary layer, a heat transfer rate decreases. The above-described increase in heat transfer performance, that occurs at a part a which air and a fin initially collides with each other, is referred to as a front-part effect. In order to increase the heat exchange performance of the heat exchanger 1, the front-part effect may be effectively utilized.

Figure 10:
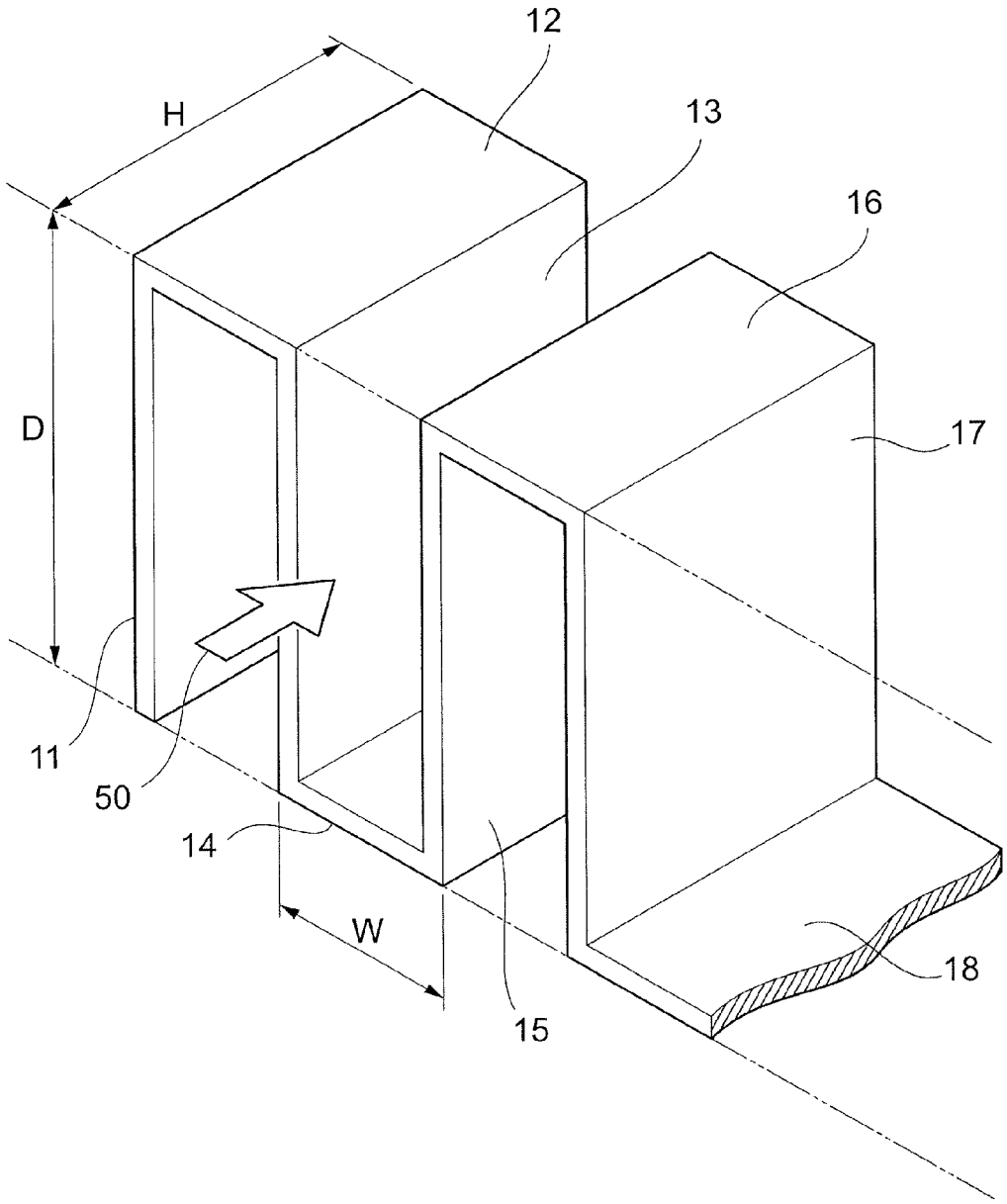
FIG. 10 is a cross-sectional view illustrating the corrugated fin according to the first embodiment of the present disclosure for comparing with a corrugated fin according to the fourth embodiment of the present disclosure.

FIG. 10 is a partial enlarged view illustrating the corrugated fin 10 according to the first embodiment. As shown in FIG. 10, the corrugated fin 10 according to the first embodiment includes a structure in which independent and adjacent fins are connected to each other. That is, in addition to the perpendicular surface 11, the ridge surface 12, the perpendicular surface 13, and the valley surface 14 shown in FIGS. 2 and 3, the corrugated fin 10 includes a perpendicular surface 15, a ridge surface 16, a perpendicular surface 17, and a valley surface 18, that are repeated parts of the perpendicular surface 11, the ridge surface 12, the perpendicular surface 13, and the valley surface 14. In this embodiment, the perpendicular surfaces 11, 13, 15, and 17 corresponding to the independent fins may be used as enlarged heat conduction surfaces, and the ridge surface 12, the valley surface 14, the ridge surface 16, and the valley surface 18 are configured to connect the perpendicular surfaces 11, 13, 15, and 17. In the embodiment, as an example of a connector that is configured to connect fins to each other, the ridge surface 12, the valley surface 14, the ridge surface 16, and the valley surface 18 are installed.

Also, in FIG. 10, D refers to a depth of the duct (a depth of the corrugated fin 10), H refers to a height of the corrugated fin 10, and W refers to a connection length (lengths of sides of the ridge surface 12, the valley surface 14, the ridge surface 16, and the valley surface 18 perpendicular to an air flow direction).

Although not shown in FIG. 10, insertion through holes may be formed at the perpendicular surfaces 11, 13, 15, and 17 and the refrigerant tube 20 may be inserted into and pass through the insertion through holes. In detail, "tube expansion" may be performed by inserting a mandrel having a diameter greater than an inner diameter of the refrigerant tube 20 into the refrigerant tube 20 and enlarging a diameter of the refrigerant tube 20 such that the refrigerant tube 20 may come into thermal contact with the perpendicular surfaces 11, 13, 15, and 17. Because the perpendicular surfaces 11, 13, 15, and 17 may be connected by the ridge surface 12, the valley surface 14, the ridge surface 16, and the valley surface 18, gaps between adjacent perpendicular surfaces 11, 13, 15, and 17 may be maintained such that a jig for adjusting a pitch of fins is unnecessary.

In embodiments where the heat exchanger 1 is used as an evaporator for a refrigerator, a thickness of the heat exchanger 1 in a depth direction of the refrigerator may be restricted to be, for example, 40 mm to 70 mm to increase an inner capacity of the refrigerator. In addition, a height of the corrugated fin 10 may be, for example, 28 mm and the corrugated fins 10 may be stacked in a direction in which air flows through the duct such that a heat conduction area is secured. Additionally, a gap of, for example, 2 mm may be provided between the corrugated fins 10 on adjacent sections.

Figure 11:
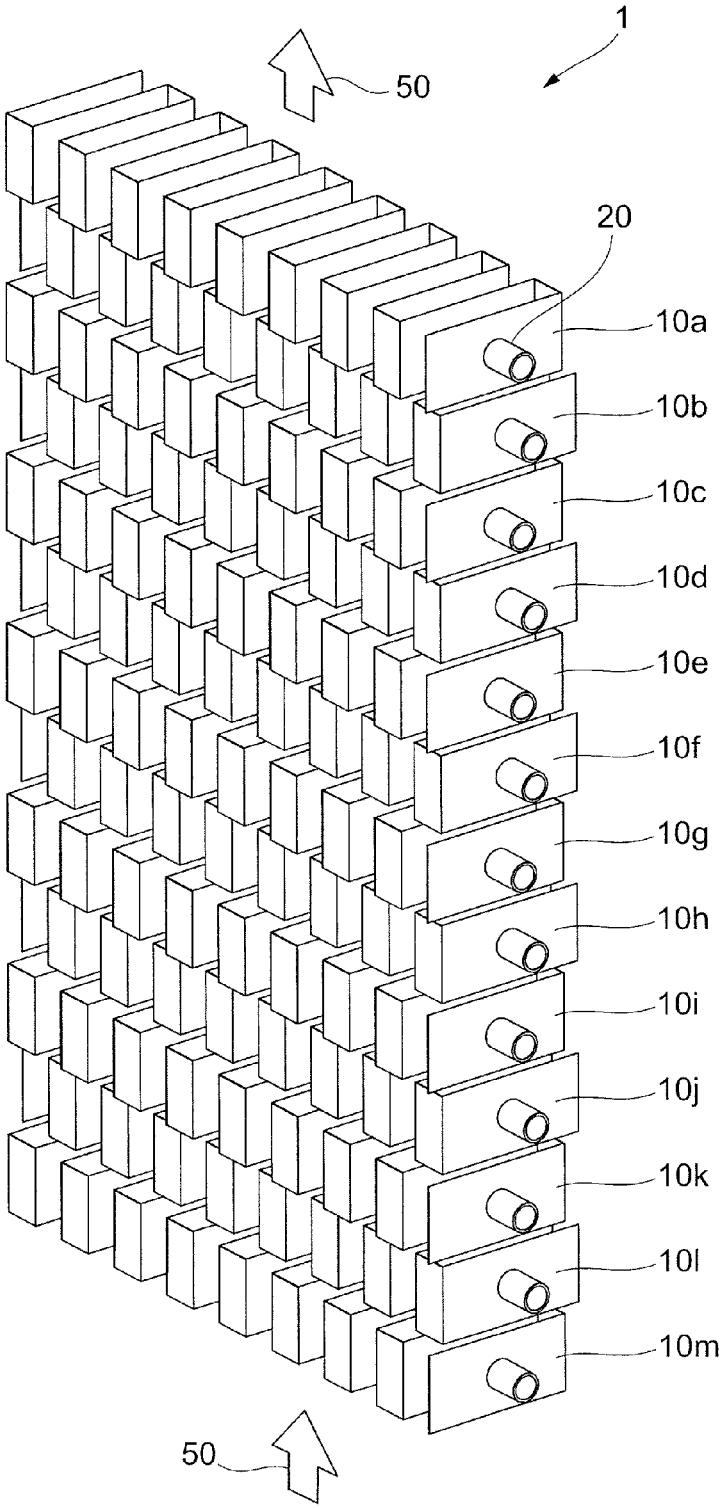
FIG. 11 is a view illustrating a structure of the heat exchanger according to the fourth embodiment of the present disclosure.

FIG. 11 is a view illustrating a structure of the heat exchanger 1 according to the fourth embodiment. As shown in FIG. 11, the corrugated fin 10 according to the fourth embodiment, like the corrugated fin 10 according to the first embodiment, may be formed by being bent to be a wave shape. Also, like FIG. 9, an air flow may be formed in the first direction from the air blowing fan, that is not shown, along the arrow 50. In addition, although not shown in the drawing, the duct may be a path through which air blown by the air blowing fan flows and may be configured to accommodate the corrugated fins 10. In some embodiments, at least a part of an inner wall of the duct may come into contact with the corrugated fin 10.

In the fourth embodiment, a depth of the corrugated fin 10 may be shorter than a depth of the duct. In FIG. 11, the corrugated fin 10 at the most upstream section is disposed to come into contact with a wall surface of the duct at a front side, and the corrugated fin 10 at a next section is disposed to come into contact with a wall surface of the duct at a rear side. Further, the corrugated fin 10 at a third section is disposed to come into contact with the wall surface of the duct at the front side, and the corrugated fin 10 at a fourth section is disposed to come into the wall surface of the duct at the rear side. That is, the corrugated fins 10 disposed at a plurality of such sections are arranged to alternately come into contact with the wall surface of the duct at the front side and the wall surface of the duct at the rear side.

Figure 12:
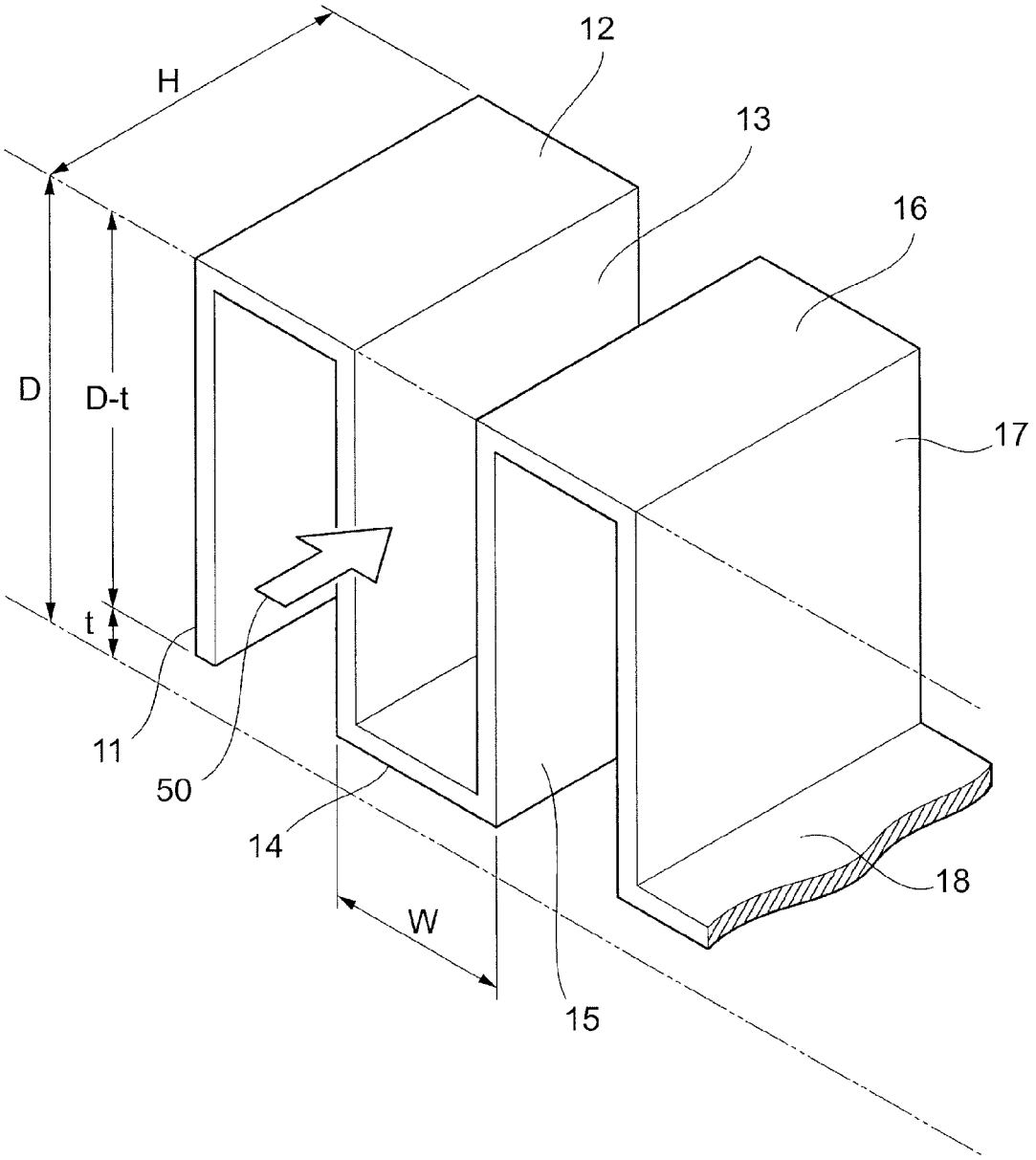
FIG. 12 is a cross-sectional view illustrating the corrugated fin according to the fourth embodiment of the present disclosure.

FIG. 12 is a partial enlarged view illustrating the corrugated fin 10 according to the fourth embodiment. As shown in FIG. 12, the corrugated fin 10 according to the fourth embodiment, as well as the corrugated fin 10 according to the first embodiment, includes the perpendicular surfaces 11, 13, 15, and 17 and the ridge surface 12, the valley surface 14, the ridge surface 16, and the valley surface 18.

In FIG. 12, D refers to a depth of the duct, H refers to a height of the corrugated fin 10, W refers to a connection length (lengths of sides of the ridge surface 12, the valley surface 14, the ridge surface 16, and the valley surface 18 perpendicular to an air flow direction), and t refers to a difference between the depth of the duct and a depth of the corrugated fin 10.

Heat exchange performance may be obtained by multiplying a heat conduction area by a forcible convection current heat transfer rate. Hereinafter, a range in which the heat exchange performance is improved in the fourth embodiment will be obtained using a simple model. A forcible convection current heat transfer rate at a wall surface of the duct is referred to as h1, and a forcible convection current heat transfer rate at a position far t mm from the duct is referred to as h2.

value K1 may be obtained by multiplying a forcible convection current heat transfer rate from a position far t mm from the duct of the corrugated fin 10 according to the first embodiment to the wall surface of the duct by a heat conduction area, and may be expressed as the following Equation:

$$K1=h1\times W\times H+\{(h1+h2)/2\}\times 4t\times H$$

As described above, because the corrugated fin 10 may be installed so as to come into contact with the wall surface of the duct in the first embodiment, a surface, at which the corrugated fin 10 comes into contact with the wall surface of the duct, does not come into contact with air and is excluded from the heat conduction area.

Meanwhile, a value K2 may be obtained by multiplying a forcible convection current heat transfer rate from a position far t mm from the wall surface of the duct of the corrugated fin 10 according to the fourth embodiment to the wall surface of the duct by a heat conduction area, and may be expressed as the following Equation:

$$K2=h2\times 2W\times H$$

In consideration of improvement of heat exchange performance in embodiments where K2 is greater than K1, a condition for improving the heat exchange performance may be expressed as the following Equation:

$$K2-K1=h2\times 2W\times H-h1\times W\times H-\{(h1+h2)/2\}\times 4t\times H>0$$

$$(2\times h2-h1)\times W\times H>(h1-h2)\times 2t\times H$$

$$t/W<(2\times h2-h1)/\{2\times(h1-h2)\}$$

For example, when an air speed at the wall surface of the duct is 0 and a forcible convection current heat transfer rate h1 at the wall surface of the duct is 0, a following condition is valid:

$$t/W<1$$

That is, when t<W, it may be seen that heat exchange performance is improved. For example, in embodiments where the corrugated fins 10, that have a height H of 28 mm and a connection length W of 5 mm, are arranged at different heights at a duct that has a depth D of 60 mm, a depth of the corrugated fin 10 for improving heat exchange performance may be calculated as follows:

$$D-t=D-W=60.0-5.0=55.0\ [\text{mm}]$$

Accordingly, the heat exchange performance is improved within a range in which the depth of the corrugated fin 10 is longer than 55 mm and shorter than 60 mm.

Figure 13:
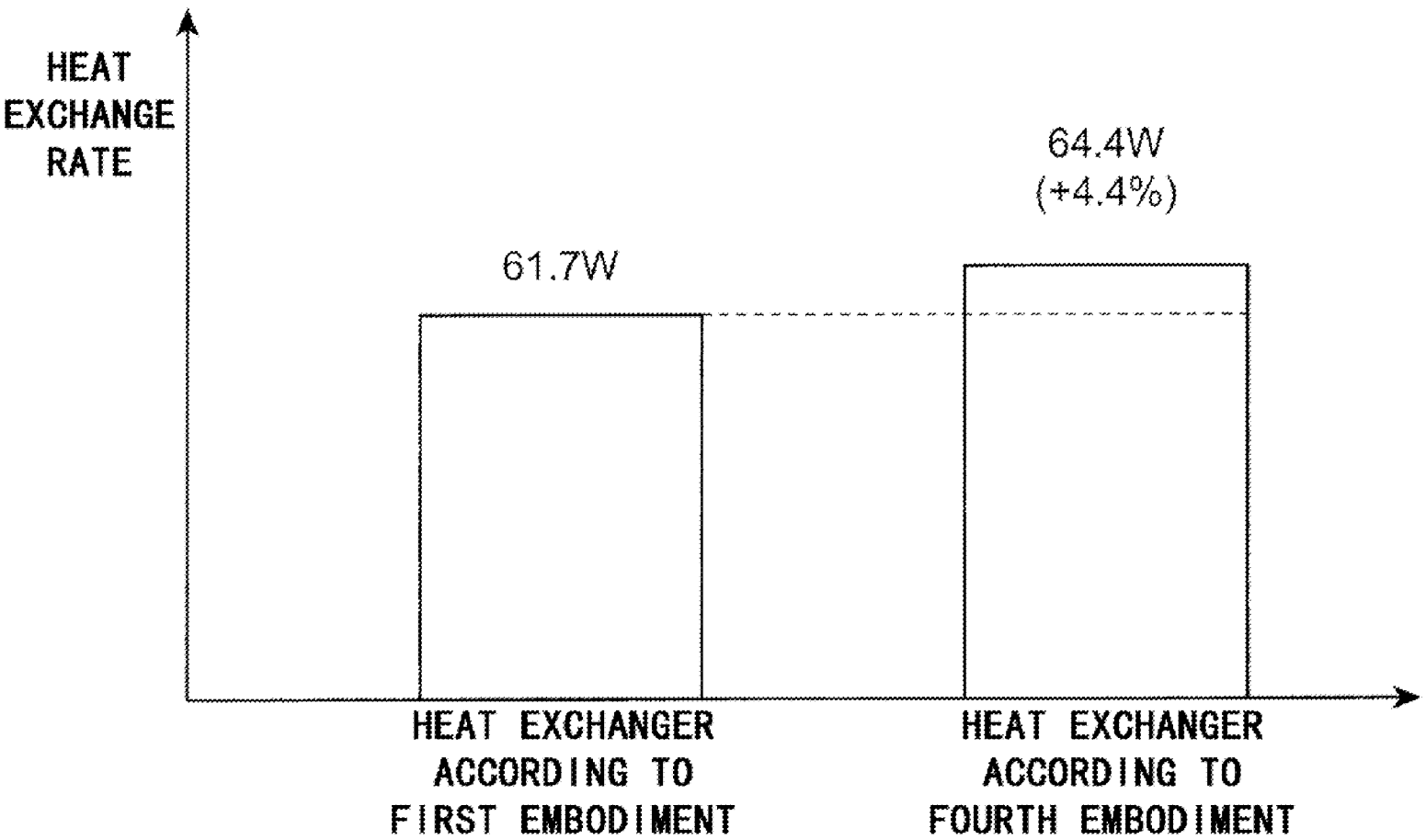
FIG. 13 is a graph illustrating a result of verifying heat exchange performance of the heat exchanger according to the first to fourth embodiments of the present disclosure.

FIG. 13 is a graph illustrating a result of verifying heat exchange performance of the heat exchanger 1 according to the first to fourth embodiments through simulations. As shown in FIG. 13, a heat exchange rate of the heat exchanger 1 according to the first embodiment is 61.7 W. Meanwhile, according to the fourth embodiment, a heat exchange rate of the heat exchanger, to which the corrugated fin 10 having a depth shorter than a depth of the duct is applied, is 64.4 W, and it may be seen that the heat exchange rate increases by about 4.4%.

Also, although the fourth embodiment has been described on the premise of structures shown in FIGS. 11 and 12, the structures are for illustration only. For example, the corrugated fin 10 on each section may not be installed to come into contact with the wall surface of the duct and may be installed to form a gap from the wall surface of the duct. Also, the corrugated fins 10 on sections may not be installed to be alternately arranged at the front side and rear side and may be installed such that any corrugated fin 10 deviates from a certain position at the rear side and another corrugated fin 10 deviates from a certain position at the front side. In this embodiment, the any corrugated fin 10 may be an example of the first corrugated fin, and the certain position at the rear side may be an example of a first position. In this embodiment, the other corrugated fin 10 may be an example of the second corrugated fin, and the certain position at the front side may be an example of a second position.

Fifth Embodiment

Figure 14A:
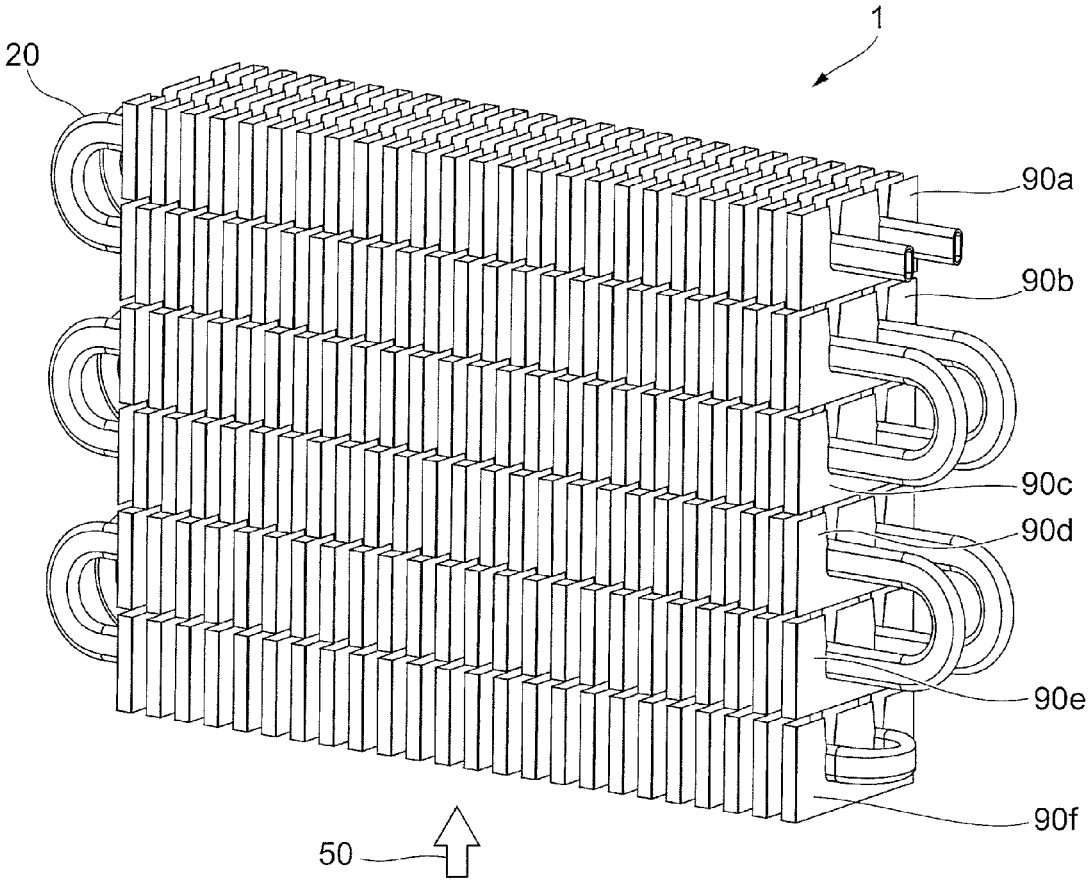
FIG. 14A is a view illustrating a structure of a heat exchanger according to a fifth embodiment of the present disclosure.

FIG. 14A is a view illustrating a structure of the heat exchanger 1 according to the fifth embodiment. As shown in FIG. 14A, the heat exchanger 1 according to the fifth embodiment includes corrugated fins 90*a*, 90*b*, 90*c*, 90*d*, 90*e*, and 90*f* and the refrigerant tube.

Figure 14B:
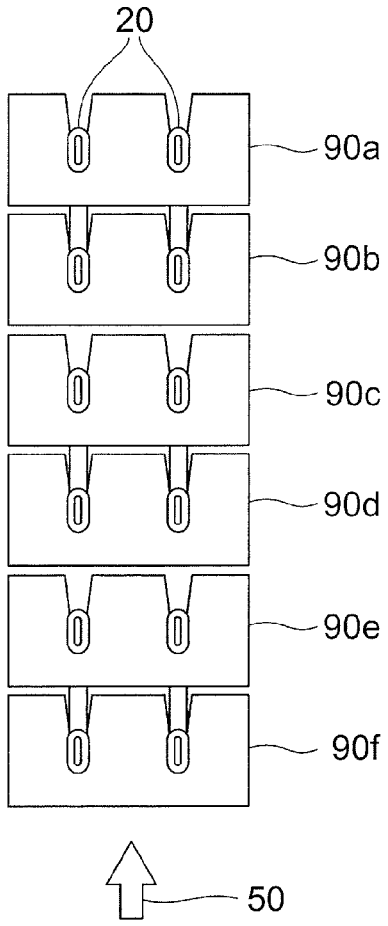
FIG. 14B is a cross-sectional view of the heat exchanger according to the fifth embodiment of the present disclosure.

FIG. 14B is a cross-sectional view taken along a plane perpendicular to the refrigerant tube 20 of the heat exchanger 1 illustrated in FIG. 14A. As shown in FIG. 14B, according to the fifth embodiment, cutout portions may be provided at the corrugated fins 90*a*, 90*b*, 90*c*, 90*d*, 90*e*, and 90*f* and the refrigerant tube 20 may be forcibly inserted into the cutout portions.

Also, in FIGS. 14A and 14B, the heat exchanger 1 may receive an air flow from an air blowing fan (not shown) in a first direction shown as the arrow 50.

Figure 15:
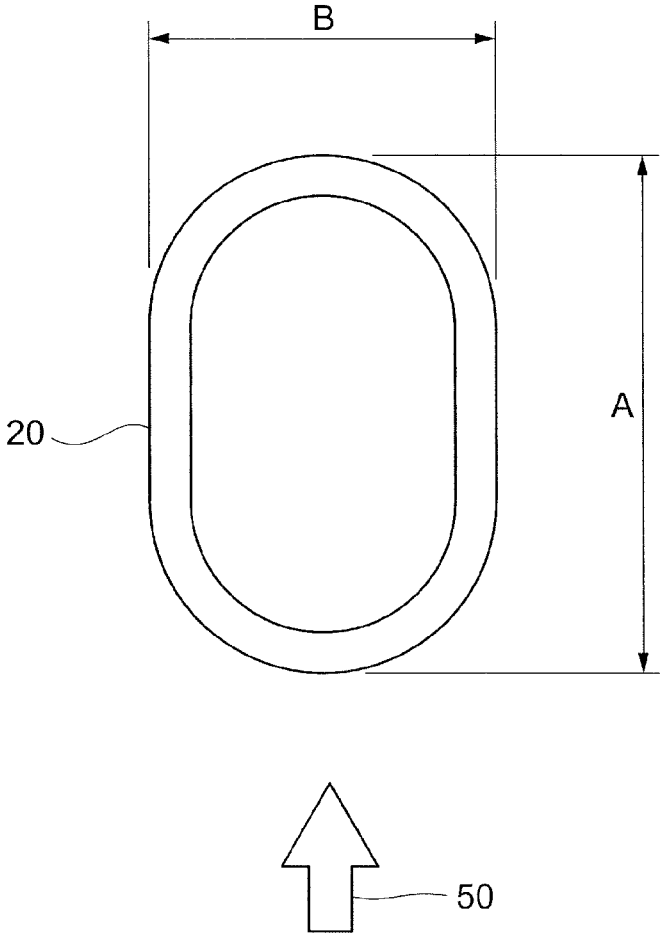
FIG. 15 is a view illustrating a definition of a flat direction of a refrigerant tube configured to be a flat tube according to the fifth embodiment of the present disclosure.

FIG. 15 is a view illustrating a definition of a flat direction of the refrigerant tube 20 that is a flat tube. As shown in FIG. 15, the refrigerant tube 20 may receive an air flow in a first direction that indicates from an air blowing fan (not shown) along an arrow 50. As shown in FIG. 15, a width of a cross section of the refrigerant tube 20 in a direction parallel to an air flow direction is referred to as A, and a width of the cross section of the refrigerant tube 20 in a direction perpendicular to the air flow direction is referred to as B.

In embodiments when a following condition is satisfied, that is, a flat shape of the refrigerant tube 20 is a shape that extends more lengthwise in a direction parallel to the air flow direction, a windage loss may be decreased and an area of a rear surface side, that becomes calm, is decreased in order to increase a heat exchange area such that heat exchange performance is improved.

$$A/B>1$$

Figure 16:
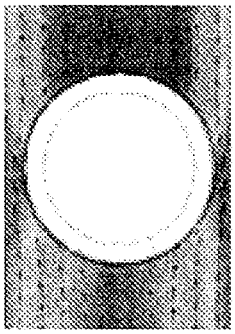
FIG. 16 is a view illustrating a result of verifying heat exchange performance of a heat exchanger in a case in which a refrigerant tube is a round tube and in a case in which a refrigerant tube is a flat tube.
Figure 16:
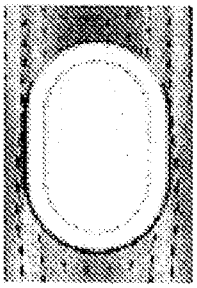
Figure 16:
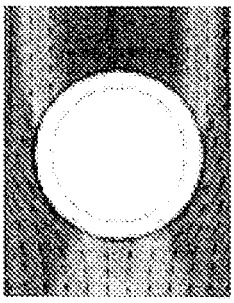
Figure 16:
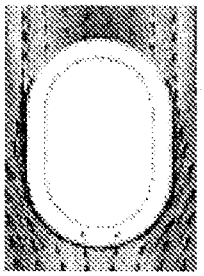

FIG. 16 is a view illustrating a result of verifying heat exchange performance of the heat exchanger 1 when the refrigerant tube 20 is a round tube or a flat tube. As shown in FIG. 16, a round tube includes a circular shape having an outer diameter of 8.5 mm, and a flat tube includes a shape formed by flattening the round tube 2 mm in any one direction. That is, in the case of the round tube, A and B are 8.5 mm and includes a circumferential length is 26.7 mm, and in the case of the flat tube, A is 9.6 mm, B is 6.5 mm, and A and B include a circumferential length is 26.7 mm like that of the round tube. In this way, as shown in FIG. 16, in the round tube, a length of an area, in which a contact flow speed to the refrigerant tube 20 is 0.1 m/s or more, is 18.8 mm at a lowermost section and is 1.4.3 mm from a second section from a bottom. Meanwhile, in the flat tube, a contact flow speed is 21.9 mm at a lowermost section and is 18.0 mm from a second section from a bottom.

Figure 17:
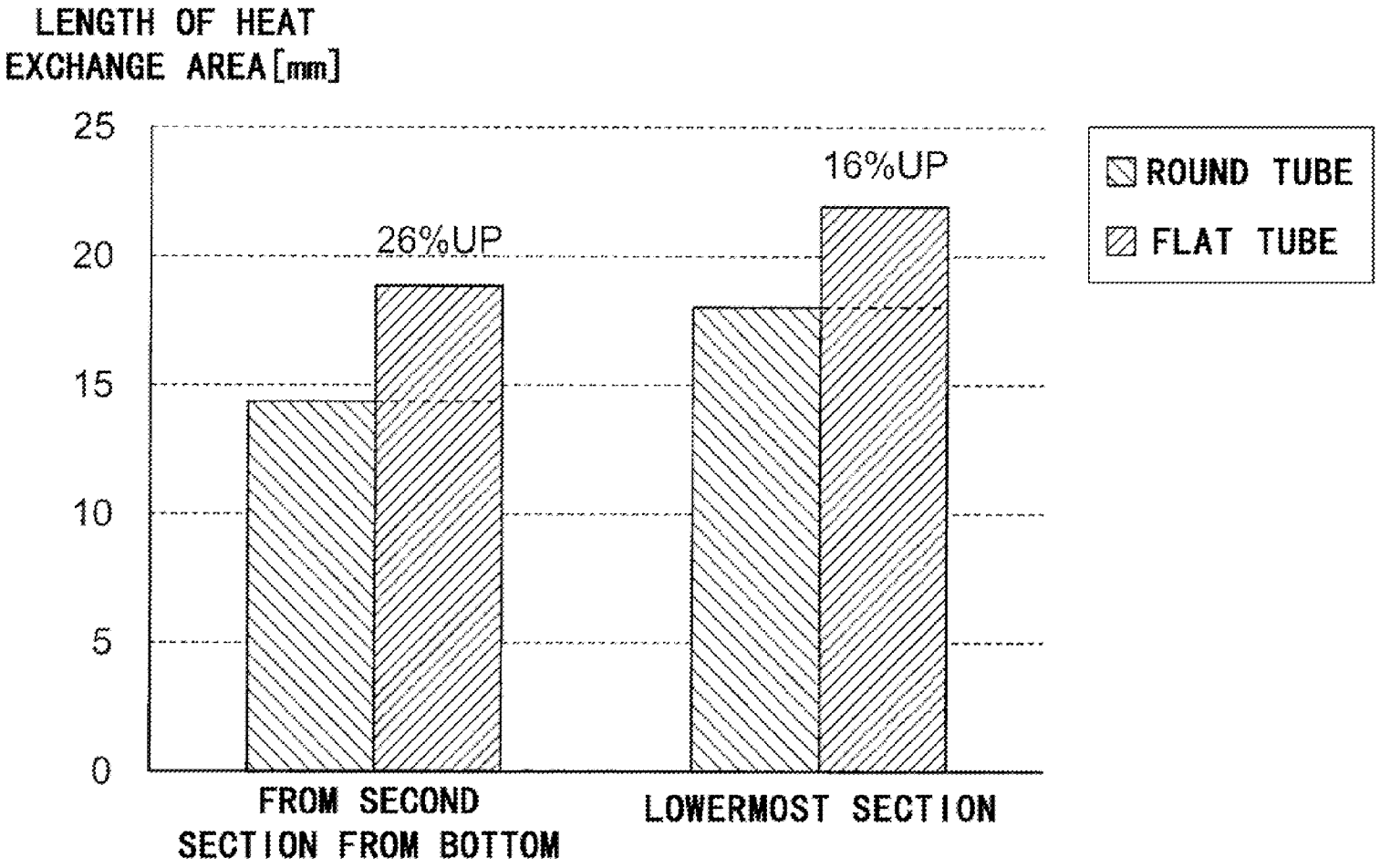
FIG. 17 is a view illustrating a difference in heat exchange performance of a heat exchanger in a case in which a refrigerant tube is a round tube and in a case in which a refrigerant tube is a flat tube.

FIG. 17 is a graph illustrating a difference in heat exchange performance of the heat exchanger 1 when the refrigerant tube 20 is a round tube or a flat tube. As shown in FIG. 17, when the refrigerant tube 20 is the flat tube, in comparison to a case in which the refrigerant tube 20 is the round tube, it may be seen that a heat exchange area increases by 16% at the lowermost section and by 26% from the second section from the bottom.

The above-described refrigerant tube 20 having a flat shape may be applied to the heat exchanger 1 according to the first to fourth embodiments.

Sixth Embodiment

Figure 18:
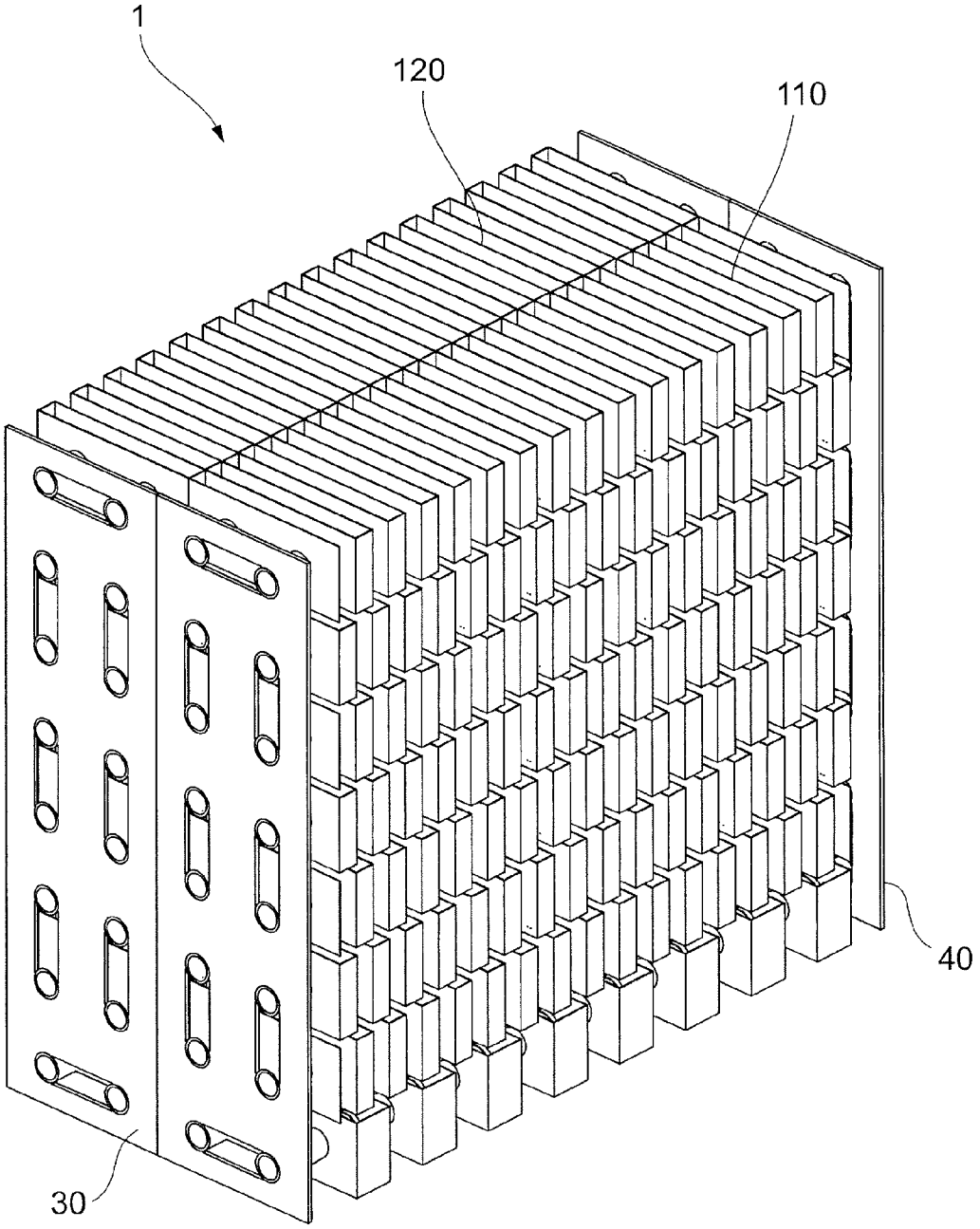
FIG. 18 is a view illustrating a structure of a heat exchanger according to a sixth embodiment of the present disclosure.

FIG. 18 is a view illustrating a structure of the heat exchanger 1 according to a sixth embodiment. As shown in FIG. 18, the heat exchanger 1 according to the sixth embodiment includes corrugated fin groups 110 and 120 arranged in parallel in a depth direction of corrugated fins and the end plates 30 and 40.

The corrugated fin groups 110 and 120 are one of a corrugated fin group of stacking the corrugated fins 10 as shown in the first embodiment, a corrugated fin group of stacking the corrugated fins 70 as shown in the second embodiment, a corrugated fin group of stacking the corrugated fins 80 as shown in the third embodiment, a corrugated fin group of stacking the corrugated fins 10 as shown in the fourth embodiment, and a corrugated fin group of stacking the corrugated fins 90 as shown in the fifth embodiment. Although the structure in which two corrugated fin groups are arranged in parallel has been described, a structure in which three or more corrugated fin groups are arranged in parallel is available.

Because the end plates 30 and 40 are like the above description with the first embodiment, a description thereof will be omitted.

According to a heat exchanger according to the sixth embodiment, it may be possible to adjust heat exchange performance to an optimum level according to a use or an applied model.

Seventh Embodiment

Continuously, a relationship between an area in which the perpendicular surface 11 (*fin*) of the corrugated fin 10 comes into contact with the refrigerant tube 20 and an area of the refrigerant tube 20 between the perpendicular surface 11 and the perpendicular surface 11 (between fins) will be described.

Figure 19:
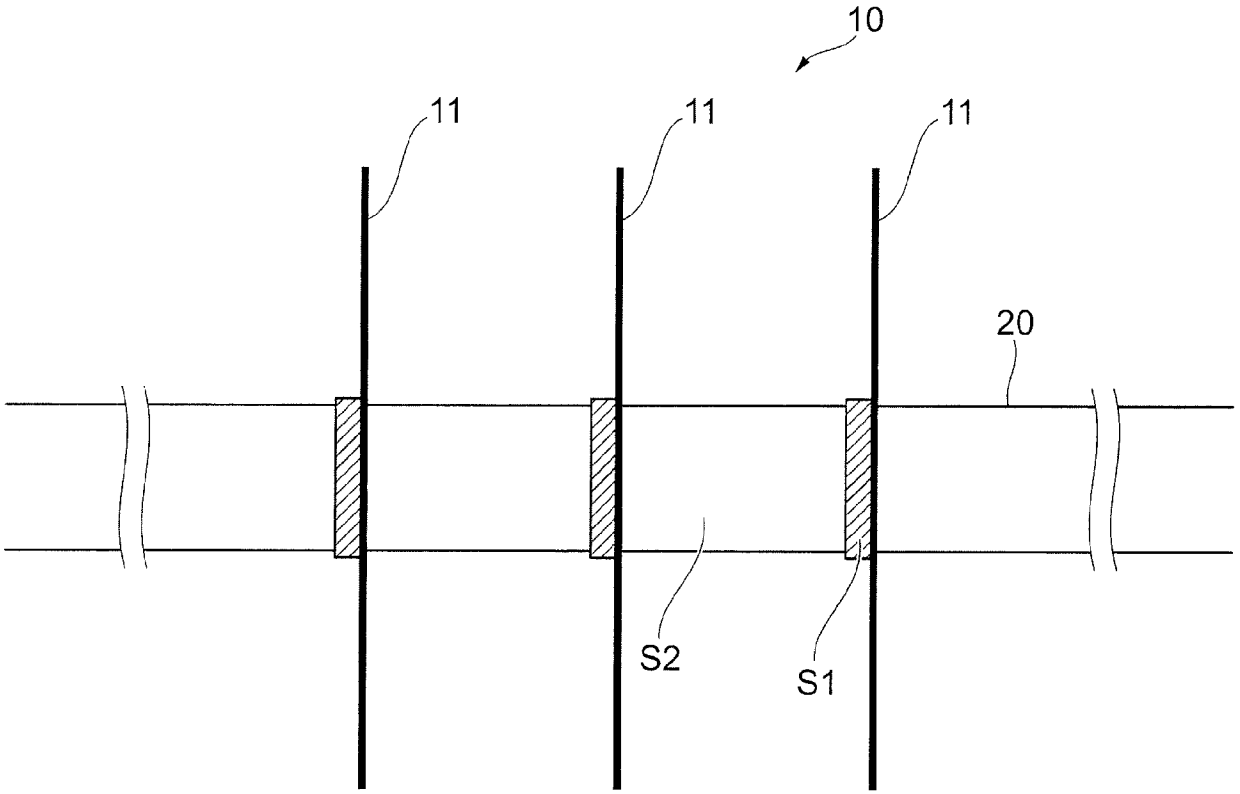
FIG. 19 is a view illustrating a relationship between an area in which a fin of a corrugated fin and a refrigerant tube are in contact with each other and an area of the refrigerant tube between fins in a heat exchanger according to a seventh embodiment of the present disclosure.

FIG. 19 is a view illustrating the relationship between the area in which the perpendicular surface 11 (*fin*) of the corrugated fin 10 comes into contact with the refrigerant tube 20 and the area of the refrigerant tube 20 between the perpendicular surface 11 and the perpendicular surface 11 (between fins) will be described. As shown in FIG. 19, when the former area is referred to as S1 and the latter area is referred to as S2, S2/S1 may become more than 0 and less than 40 in the seventh embodiment.

In the case of the heat exchanger according to the seventh embodiment, it may be possible to prevent performance from being deteriorated by dust or the growth of frost.

Effects of First to Seventh Embodiments

In the first to seventh embodiments of the present disclosure, an assembling property and reliability of the heat exchanger 1 may be improved by configuring the corrugated fin 10 to be an independent, approximately rectangular-shaped fin, and heat exchange performance may be improved by increasing a heat conduction area.

A configuration of the heat exchanger 1 according to an applied apparatus or part may be randomly set by combining the independent approximately rectangular-shaped corrugated fins 10 having different distances between fins.

Heat exchange performance may be improved by reducing a windage loss using a flat refrigerant tube 20.

Schema of Eighth to Tenth Embodiments

According to eighth to tenth embodiments of the present disclosure, in a heat exchanger fin formed by combining a plurality of fins inserted into and passed through a refrigerant tube, an expansion plate may be installed with respect to the fin to increase a heat conduction area such that heat dissipation performance is improved.

Productivity may be improved by employing the same shape as the plurality of fins that form the heat exchanger fin.

Eighth Embodiment

Figure 20:
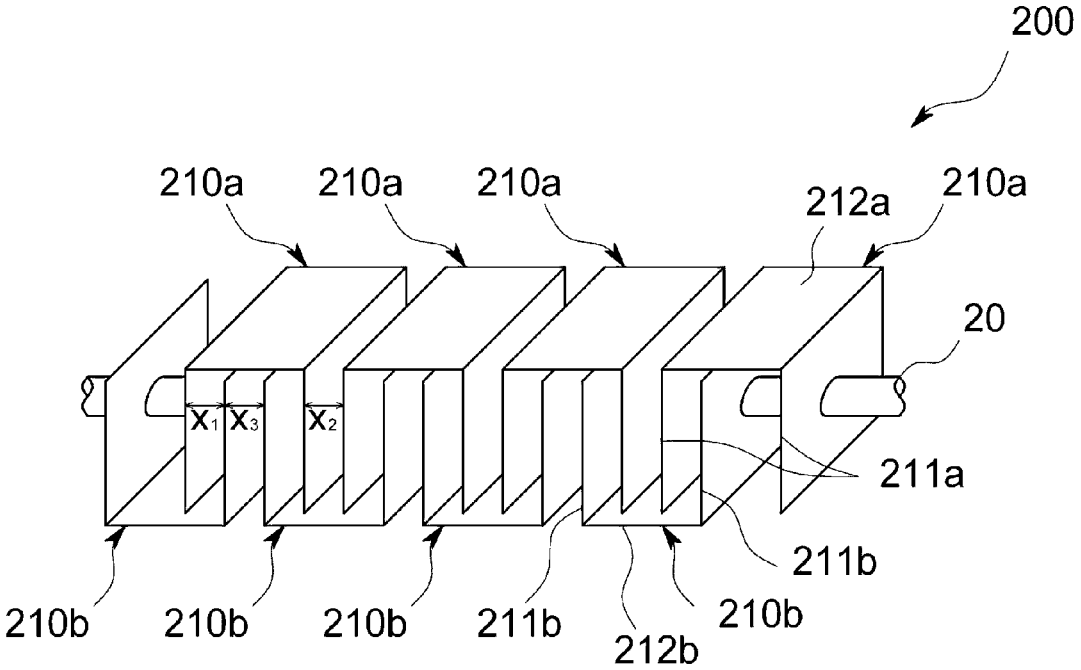
FIG. 20 is a schematic diagram illustrating a heat exchanger fin according to an eighth embodiment of the present disclosure.

A heat exchanger tin 200 according to the embodiment, as shown in FIG. 20, includes a plurality of fins 210 that dissipate heat generated by the refrigerant tube 20 and are arranged on the refrigerant tube 20.

The fin 210 includes a pair of dissipating plates 211 with a gap therebetween, through which the refrigerant tube 20 may be inserted and pass, and an expansion plate 212 disposed between the pair of dissipating plates 211. The pair of dissipating plates 211 may be disposed to be approximately perpendicular to the refrigerant tube 20, and the expansion plate 212 may extend along the refrigerant tube 20. In this embodiment, the fin 210 is formed by bending a rectangular-shaped flat plate to be an approximate rectangular shape (approximate U shape).

Also, hereinafter, the fin 210 in which the expansion plate 212 is disposed on one side with respect to the refrigerant tube 20 will be referred to as a first fin 210*a*, and the fin 210 in which the expansion plate 212 is disposed on the other side opposite to the one side with respect to the refrigerant tube 20 will be referred to as a second fin 210*b*.

The first fin 210*a* and the second fin 210*b* may be alternately arranged along a longitudinal direction of the refrigerant tube 20. In the first fin 210*a* and the second fin 210*b*, adjacent to each other, expansion plates 212*a* and 212*b* of the first fin 210*a* and the second fin 210*b* are arranged in parallel with the refrigerant tube 20 interposed therebetween and also are disposed to partially face each other.

Through the above structure, a dissipating plate 211*a* on one side of the first fin 2110*a* (a right side in FIG. 20) is disposed between dissipating plates 211*b* on both sides of the second fin 210*b* adjacent to the one side, and a dissipating plate 211*a* on the other side of the first fin 210*a* (a left side in FIG. 20) is disposed between dissipating plates 211*b* on both sides of the second fin 210*b* adjacent to the other side. The dissipating plate 211*b* on one side of the second fin 210*b* is disposed between the dissipating plates 211*a* on both sides of the first fin 210*a* adjacent to the one side, and the dissipating plate 211*b* on the other side of the second fin 210*b* is disposed between the dissipating plates 211*a* on both sides of the first fin 210*a* adjacent to other side.

The first fin 210*a* and the second fin 210*b*, adjacent to each other, are arranged to allow a distance x1 between the dissipating plates 211*a* and 211*b* arranged on the other side thereof (that is, a distance between the dissipating plate 211*a* of the first fin 210*a*, disposed on the second fin 210*b* side, and the dissipating plate 211*b* of the second fin 210*b*, disposed on the first fin 210*a* side) to be a certain distance. The adjacent first and second fins 210*a* and 210*b* are arranged to allow a distance x2 between the adjacent first fins 210*a* and a distance x3 between the adjacent second fins 210*b* to be certain distances. The distances x1, x2, and x3 are the same size, and all the dissipating plates 211*a* and 211*b* through which the refrigerant tube 20 may be inserted and pass are equidistantly arranged. Also, all the distances x1, x2, and x3 may be 3 mm or more and 30 mm or less.

Ninth Embodiment

Figure 21:
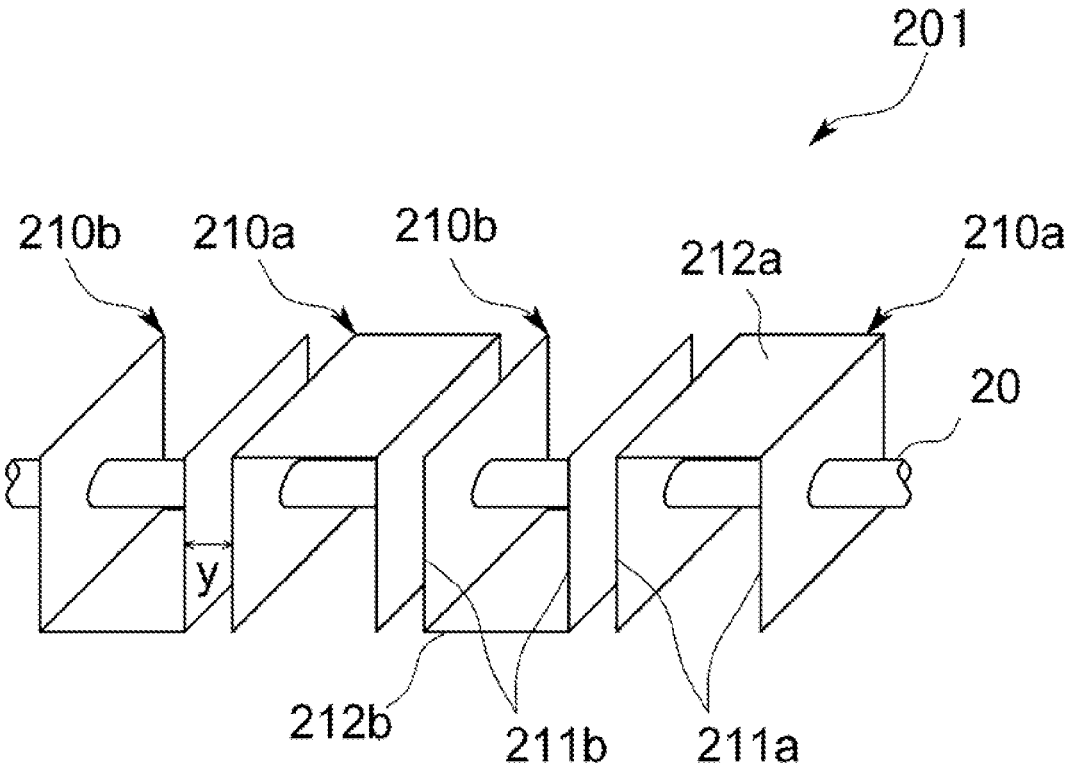
FIG. 21 is a schematic diagram illustrating a heat exchanger fin according to a ninth embodiment of the present disclosure.

A heat exchanger fin 201 according to the ninth embodiment, shown in FIG. 21, differs from the heat exchanger fin 200 according to the eighth embodiment in an arrangement of the first fin 210*a* and the second fin 210*b* with respect to the refrigerant tube 20.

In the heat exchanger fin 201, the first fin 210*a* and the second fin 210*b* are alternately arranged along a longitudinal direction of the refrigerant tube 20. Also, the expansion plates 212*a* and 212*b* of each of the adjacent first and second fins 210*a* and 210*b* are arranged in parallel with the refrigerant tube 20 therebetween and also not to face each other.

Also, the adjacent first and second fins 210*a* and 210*b* are arranged to allow a distance y between the dissipating plates 211*a* and 211*b* arranged on the other side thereof to be a certain distance. The distance y may be 3 mm or more and 30 mm or less.

Tenth Embodiment

Figure 22:
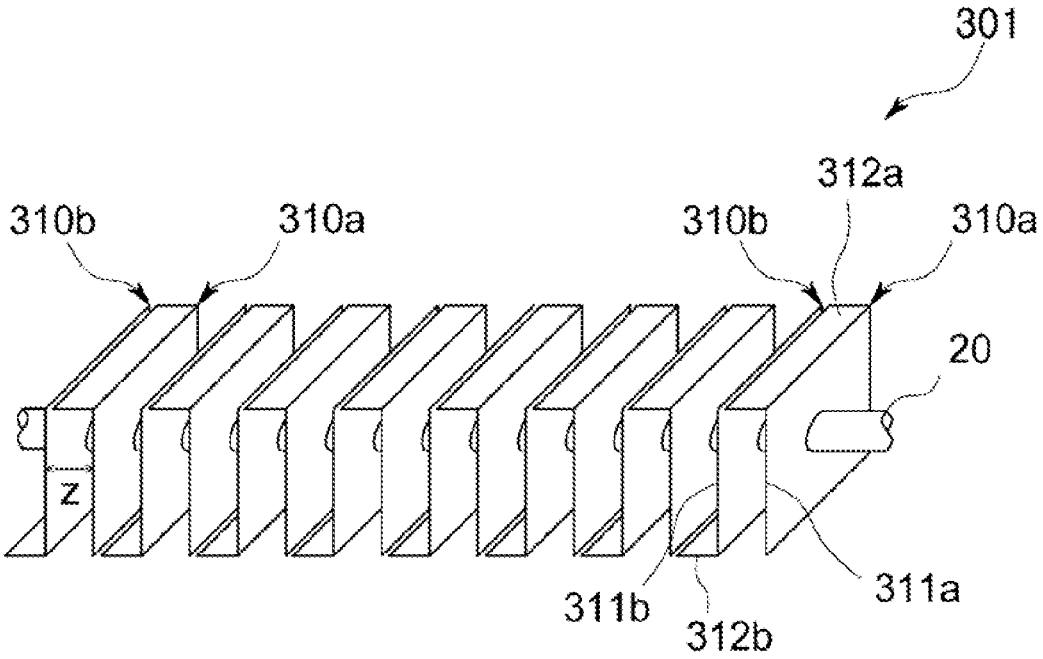
FIG. 22 is a schematic diagram illustrating a heat exchanger fin according to a tenth embodiment of the present disclosure.

A heat exchanger fin 301 according to the tenth embodiment, as shown in FIG. 22, includes a plurality of fins 310 comprising a shape, different from the heat exchanger fin 200 according to the eighth embodiment, arranged on the refrigerant tube 20.

The fin 310 includes a dissipating plate 311, through which the refrigerant tube 20 may be inserted and pass, and an expansion plate 312 that is configured to extend from the dissipating plate 311 along the refrigerant tube 20. The fin 310 according to the embodiment may be formed by bending a rectangular-shaped panel to be an L shape.

Hereinafter, the fin 310 in which the expansion plate 312 is disposed on one side with respect to the refrigerant tube 20 will be referred to as a first fin 310*a*, and the fin 310 in which the expansion plate 312 is disposed on the other side opposite to the one side with respect to the refrigerant tube 20 will be referred to as a second fin 310*b*.

The first fin 310*a* and the second fin 310*b* are alternately arranged along a longitudinal direction of the refrigerant tube 20. Also, the expansion plates 312*a* and 312*b* of each of the adjacent first and second fins 310*a* and 310*b* are arranged in parallel to each other with the refrigerant tube 20 therebetween and also not to face each other. Hereby, the heat exchanger fin 300 includes a corrugated fin shape overall.

The adjacent first and second fins 310*a* and 310*b* are arranged to allow a distance z between the adjacent dissipating plates 311*a* and 311*b* to be a certain distance. The distance z may be the same as widths of the expansion plates 312*a* and 312*b* or may be slightly longer than the widths of the expansion plates 312*a* and 312*b*. The distance z may be 3 mm or more and 30 mm or less.

Effects of Eighth to Tenth Embodiments

Through the above configurations, air, that flows through each fin, comes into contact with not only a dissipating plate, through which a refrigerant tube may be inserted and pass, but also an expansion plate such that a heat conduction area of each fin increases and a heat dissipation effect may be improved.

Because fins comprising the same shape may be applied, manufacturing costs may be reduced.

Particularly, in the case of the heat exchanger fin according to the eighth embodiment, because expansion plates of adjacent fins partially face each other, a heat conduction area increases more than that of a corrugated fin such that heat dissipation efficiency may be noticeably improved.

Schema of Eleventh Embodiment

In a heat exchanger, frost formed at a part located on an upstream side of an air flow generated by an air blowing fan may be suppressed.

Each of heat exchanger fins has the same shape such that manufacturing costs are reduced.

Eleventh Embodiment

Figure 23:
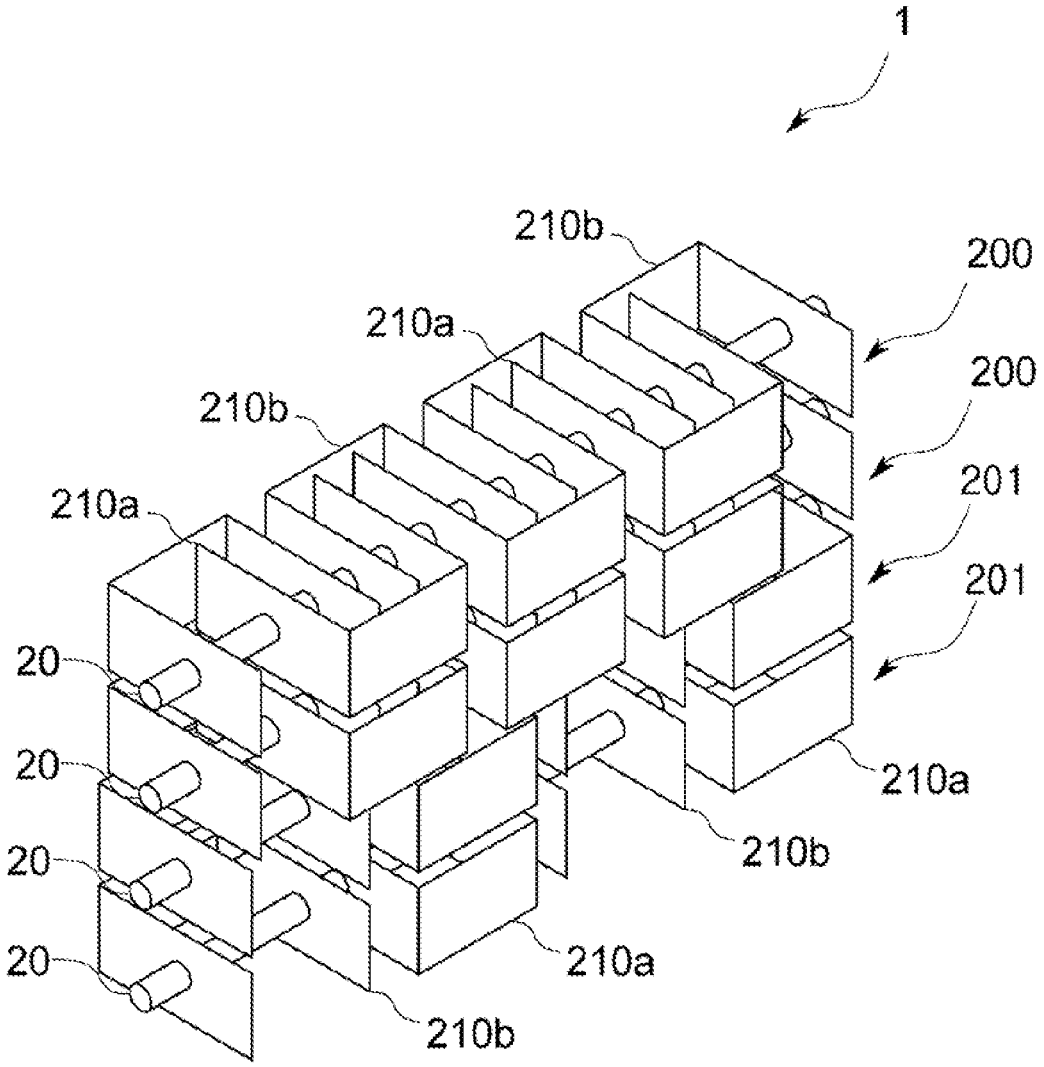
FIG. 23 is a schematic diagram illustrating a heat exchanger fin according to an eleventh embodiment of the present disclosure.

The heat exchanger 1 according to the embodiment includes the heat exchanger fin 200 according to the eighth embodiment and the heat exchanger fin 201 according to the ninth embodiment detail, the heat exchanger 1 according to the embodiment, as shown in FIG. 23, includes the refrigerant tube 20 including a plurality of sections bent in a meander shape and the heat exchanger fins 200 and 201 arranged on each section of the refrigerant tube 20 and through which air blown by an air blowing fan passes. In this embodiment, the air blown by the air blowing fan may flow from a lower side toward an upper side.

The heat exchanger fins 201 according to the ninth embodiment may be arranged on a first section and a second section of a refrigerant tube, arranged on an upstream side of an air flow, and the heat exchanger fins 200 according to the eighth embodiment may be arranged on a third section and a fourth section of the refrigerant tube, arranged on a downstream side of the air flow. In this embodiment, all the fins 210 of the heat exchanger fins 200 and 201 include the same shape. The distance x1 (refer to FIG. 20) of the heat exchanger fin 200 according to the eighth embodiment and the distance y (refer to FIG. 21) of the heat exchanger fin 201 according to the ninth embodiment are configured to have the same length.

According to the above configuration, all the fins 210 used for the heat exchanger 1 include the same shape, as well as, the heat exchanger fin 200 configured to include a narrow part (refer to FIG. 23) as a distance between dissipating plates 211 and the heat exchanger fin 201 configured to have a wide part (refer to FIG. 23) and a narrow part (refer to FIG. 23) as distances between the dissipating plates 211 may be arranged.

The heat exchanger fin 201 according to the ninth embodiment may be disposed at the upstream side of the air flow and the heat exchanger fin 200 according to the eighth embodiment may be disposed at the downstream side of the air flow such that frost that easily occurs at the upstream side of the air flow may be suppressed.

Schema of Twelfth Embodiment

In a heat exchanger, when two heat exchanger fins are adjacently arranged, expansion plates included in both the heat exchanger fins are arranged may not overlap each other such that water drops generated during defrosting efficiently flow down.

Twelfth Embodiment

Figure 24:
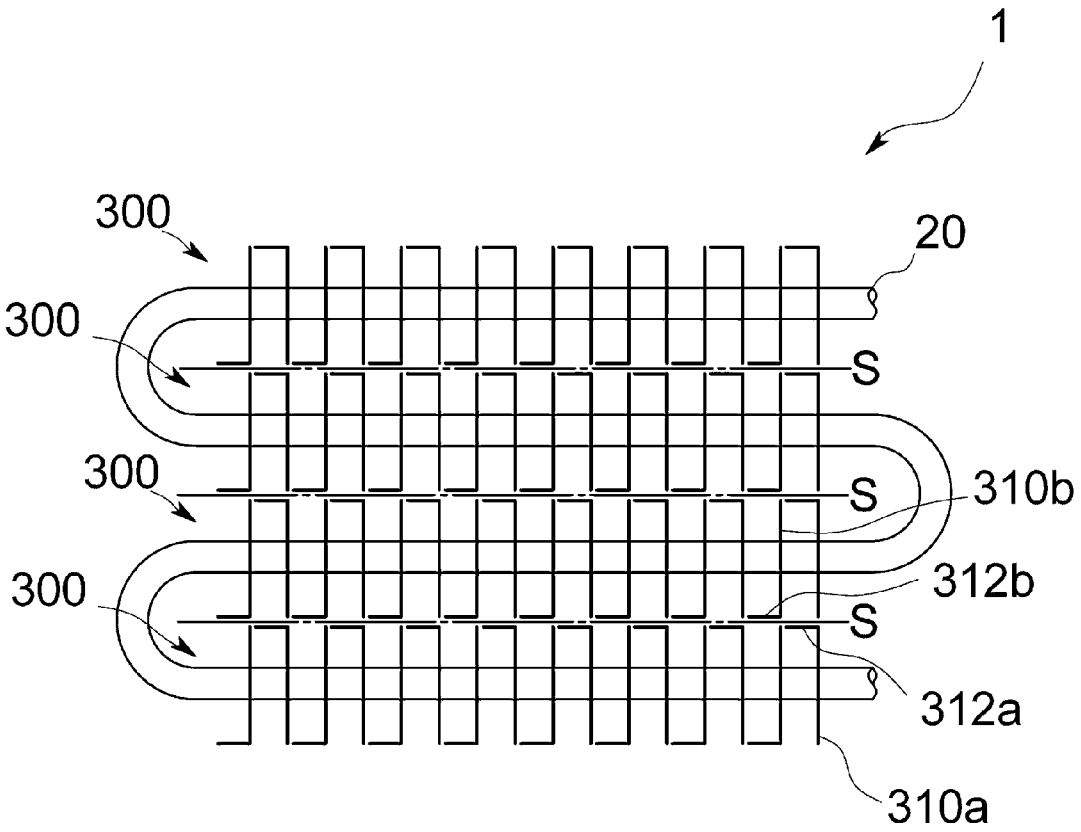
FIG. 24 is a schematic diagram illustrating a heat exchanger fin according to a twelfth embodiment of the present disclosure.

The heat exchanger 1 according to the embodiment, as shown in FIG. 24, includes the refrigerant tube 20, including a plurality of sections bent in a meander shape, and heat exchanger fins 300 arranged on each section of the refrigerant tube 20 and through which air blown by an air blowing fan passes. All the heat exchanger fins 300 include the same configuration. In FIG. 24, air blown by the air blowing fan flows from a front side toward an inner side.

All the heat exchanger fins 300 arranged on the sections of the refrigerant tube 20 may be arranged to allow all expansion plates 312*a* and 312*b* to be parallel. Hereby, with respect to adjacent surfaces S (shown as a long and short dash line) between the heat exchanger fins 300 arranged on the adjacent sections, the expansion plate 312*a* of the fin 310*a* of the heat exchanger fin 300 may be disposed on the section on one side thereof (section located below the adjacent surface S) and the expansion plate 312*b* of the fin 310*b* of the heat exchanger fin 300 may be disposed on the section on the other side thereof (section located above the surface S). Further, the expansion plate 312*a* and the expansion plate 312*b*, that face the adjacent surface S, may be arranged not to overlap each other.

According to the above configuration, because the expansion plates of the heat exchanger fins 300 arranged on the adjacent sections do not overlap each other even when a plurality of such heat exchanger fins come into close contact with one another to form a compact heat exchanger, water drops generated on the expansion plates during defrosting easily flow down. In addition, a heat conduction area of the heat exchanger fin may be increased by the expansion plate such that heat dissipation performance may also be improved.

Also, in the embodiment, although the expansion plates of the heat exchanger fins arranged on the adjacent sections may be arranged not to completely overlap each other, they may be arranged to partially overlap each other within an allowable range.

The collars according to the first embodiment may be applied to the heat exchanger fins of the eighth to twelfth embodiments. In detail, the collar may be formed at the insertion through hole through which the refrigerant tube may be inserted and pass in the heat dissipating plate included in the heat exchanger fin.

As is apparent from the description of the present disclosure, heating performance may be improved by increasing a heat conduction area between a refrigerant tube and a heat exchanger fin in a heat exchanger.

Heat dissipation performance may be improved by increasing a surface in contact with air in a heat exchanger fin formed by combining a plurality of fins.

When a heat conduction area of a heat exchanger fin is increased in a heat exchanger, water drops generated on a surface of an adjacent fin efficiently flow down during defrosting by reducing an overlap of fins in a surface adjacent to the adjacent fin.

Although a few embodiments of the present disclosure have been shown and described, it would be appreciated by those skilled in the art that changes may be made in these embodiments without departing from the principles and spirit of the disclosure, the scope of which is defined in the claims and their equivalents.

Although the present disclosure has been described with various embodiments, various changes and modifications may be suggested to one skilled in the art. It is intended that the present disclosure encompass such changes and modifications as fall within the scope of the appended claims.

What is claimed is:

1. A heat exchanger comprising:

at least one refrigerant tube configured to comprise a plurality of sections arranged in a first direction; and a plurality of heat exchanger fins arranged on the plurality of sections, wherein, for a section of the plurality of sections, a first heat exchanger fin of the plurality of heat exchanger fins is arranged adjacent to a second heat exchanger fin of the plurality of heat exchanger fins on the section, wherein each of the plurality of heat exchanger fins comprises:

a first flat surface disposed perpendicular to the refrigerant tube arranged in a second direction perpendicular to the first direction, a second flat surface disposed perpendicular to the refrigerant tube arranged in the second direction, a through hole in the first flat surface and the second flat surface, the through hole configured to allow the at least one refrigerant tube to be inserted through the first flat surface and the second flat surface in the second direction, a first contact member configured to protrude from only one side of the first flat surface around the through hole and surround an outer circumferential surface of the refrigerant tube, and a second contact member configured to protrude from only one side of the second flat surface around the through hole and surround an outer circumferential surface of the refrigerant tube, wherein, for each of the plurality of heat exchanger fins, a pair of contact members adjacent to each other along the refrigerant tube are configured to protrude from their respective flat surfaces toward each other, wherein respective ends of the pair of contact members adjacent to each other are detached from each other, wherein a first flat surface of the second heat exchanger fin is disposed between first and second flat surfaces of the first heat exchanger fin in the second direction, and wherein the first flat surface of the first heat exchanger fin is disposed between the first flat surface and a second flat surface of the second heat exchanger fin in the second direction.

2. The heat exchanger of claim 1, wherein the first contact member is formed to be with the through hole as a hole.

3. The heat exchanger of claim 1, wherein the plurality of heat exchanger fins comprise:

a heat exchanger fin of the plurality of heat exchanger fins arranged on a first section of the plurality of sections is configured to have a first distance between first and second flat surfaces along the first section; and a heat exchanger fin of the plurality of heat exchanger fins arranged on a second section of the plurality of sections is configured to have a second distance between first and second flat surfaces along the second section, wherein the second distance is greater than the first distance.

4. The heat exchanger of claim 3, comprising an air blowing fan configured to blow air toward the plurality of heat exchanger fins, wherein the first section is disposed at a downstream side lower than the second section with respect to a flow of air blown by an air blowing fan.

5. The heat exchanger of claim 1, wherein each of the plurality of heat exchanger fins further comprises:

a first connector configured to connect the first flat surface to the second flat surface.

6. The heat exchanger of claim 5, wherein the first connector is arranged to be parallel to a flow of air blown by an air blowing fan.

7. The heat exchanger of claim 5, wherein the first connector is formed to be concave toward the refrigerant tube.

8. The heat exchanger of claim 5, wherein the first connector comprises a louver formed toward the refrigerant tube.

9. The heat exchanger of claim 1, comprising an air blowing fan configured to blow air toward the heat exchanger fins, wherein the refrigerant tube is configured to have a flat shape in which a first width extending in a direction parallel to a flow of air blown by an air blowing fan and a second width extending in a direction perpendicular to the flow of the air blown are different from each other.

10. The heat exchanger of claim 9, wherein the first width is greater than the second width.

11. The heat exchanger of claim 1, wherein, between two adjacent flat surfaces, a ratio between a contact area of a part at which a contact member is in contact with the refrigerant tube and a non-contact area of a part at which the contact member does not come into contact with the refrigerant tube is greater than 0 and smaller than 40.

12. The heat exchanger of claim 1, wherein each of the plurality of heat exchanger fins comprises:

a pair of heat exchanger plates through which the refrigerant tube passes; and an expansion plate configured to extend in the second direction and connect the pair of heat exchanger plates to each other.

13. The heat exchanger of claim 12, wherein:

the first heat exchanger fin is configured to comprise a first expansion plate disposed on one side of the refrigerant tube; and the second heat exchanger fin is configured to comprise a second expansion plate disposed on another side of the refrigerant tube opposite the one side of the refrigerant tube.

14. The heat exchanger of claim 13, wherein the first expansion plate and the second expansion plate are alternately arranged along the second direction, at least one part of the first expansion plate and at least one part of the second expansion plate are arranged to face each other.

15. A heat exchanger comprising:

at least one refrigerant tube configured to comprise a plurality of sections arranged in a first direction; and a plurality of heat exchanger fins arranged on the plurality of sections, wherein, for a section of the plurality of sections, a first heat exchanger fin of the plurality of heat exchanger fins is arranged adjacent to a second heat exchanger fin of the plurality of heat exchanger fins on the section, wherein each of the plurality of heat exchanger fins comprises:

at least one V-shaped or U-shaped cut out configured to allow the at least one refrigerant tube to be inserted thereinto in a second direction perpendicular to the first direction; and a plurality of flat surfaces perpendicular to the refrigerant tube arranged in the second direction, at least one contact member configured to protrude from only one side of each of the plurality of flat surfaces around the at least one V-shaped or U-shaped cut out and at least partially surround an outer circumferential surface of the refrigerant tube, wherein at least one pair of contact members adjacent to each other along the refrigerant tube are configured to protrude from their respective flat surfaces toward each other, wherein respective ends of the at least one pair of contact members adjacent to each other are detached from each other, and wherein a flat surface of the plurality of flat surfaces of the second heat exchanger fin is disposed between two of the plurality of flat surfaces of the first heat exchanger fin in the second direction, and wherein a flat surface of the plurality of flat surfaces of the first heat exchanger fin is disposed between two of the plurality of flat surfaces of the second heat exchanger fin in the second direction.

* * * * *